US008419148B2

(12) United States Patent
Suzuki

(10) Patent No.: US 8,419,148 B2
(45) Date of Patent: Apr. 16, 2013

(54) DROPLET EJECTING DEVICE CAPABLE OF INCREASING NUMBER OF TONES EFFICIENTLY

(75) Inventor: Yoshihumi Suzuki, Ena (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 224 days.

(21) Appl. No.: 13/027,340

(22) Filed: Feb. 15, 2011

(65) Prior Publication Data

US 2011/0205272 A1 Aug. 25, 2011

(30) Foreign Application Priority Data

Feb. 19, 2010 (JP) ..... 2010-034994

(51) Int. Cl.
*B41J 29/38* (2006.01)

(52) U.S. Cl.
USPC ..... 347/10

(58) Field of Classification Search ..... 347/9–11, 347/68, 70–72
See application file for complete search history.

(56) References Cited

U.S. PATENT DOCUMENTS

| | | | | |
|---|---|---|---|---|
| 5,992,756 | A | 11/1999 | Newcombe et al. | |
| 6,273,539 | B1 * | 8/2001 | Suzuki | 347/12 |
| 7,600,838 | B2 * | 10/2009 | Iriguchi | 347/10 |
| 2005/0024400 | A1 | 2/2005 | Satake et al. | |
| 2009/0167823 | A1 | 7/2009 | Kojima et al. | |

FOREIGN PATENT DOCUMENTS

| | | | |
|---|---|---|---|
| EP | 1661705 | A1 | 5/2006 |
| EP | 2075133 | A2 | 7/2009 |
| JP | H09-011459 | A | 1/1997 |
| JP | H11-010866 | A | 1/1999 |
| JP | 2000-503916 | A | 4/2000 |
| JP | 2000-141647 | A | 5/2000 |
| JP | 2005-035295 | A | 2/2005 |
| JP | 2009-172997 | A | 8/2009 |
| JP | 2009-226676 | A | 10/2009 |

OTHER PUBLICATIONS

European Patent Office, extended European Search Report for European Patent Application No. 11154514.1, dated Mar. 28, 2011.
Japan Patent Office, Decision to Grant a Patent for Japanese Patent Application No. 2010-034994 (counterpart Japanese patent application), mailed Feb. 26, 2013.

* cited by examiner

*Primary Examiner* — An Do
(74) *Attorney, Agent, or Firm* — Baker Botts L.L.P.

(57) ABSTRACT

A voltage-set-information storing section stores two or more kinds of voltage sets each including a combination of first and second voltages for each number of droplets ejected from an ejection port within a single recording cycle. A voltage applying section is configured to apply the first voltage to an active portion of a first piezoelectric layer and to apply the second voltage to an active portion of a second piezoelectric layer based on image data of the image. The voltage applying section is configured to select one of the two or more kinds of voltage sets stored in the voltage-set-information storing section and to apply each voltage constituting the selected voltage set to the active portions of the first and second piezoelectric layers. The voltage sets are classified by a degree of temporal overlapping of pulse-shaped voltages included in the first and second voltages.

18 Claims, 13 Drawing Sheets

DROPLET EJECTING DEVICE CAPABLE OF INCREASING NUMBER OF TONES EFFICIENTLY

CROSS REFERENCE TO RELATED APPLICATIONS

This application claims priority from Japanese Patent Application No. 2010-034994 filed Feb. 19, 2010. The entire content of the priority application is incorporated herein by reference.

TECHNICAL FIELD

The invention relates to a droplet ejecting device that ejects droplets such as ink from ejection ports.

BACKGROUND

In an inkjet-type printer which is an example of droplet ejecting devices, such a technique is known that ejection energy is applied to ink within a pressure chamber by driving of piezoelectric actuator so that an ink droplet is ejected from an ejection port of a nozzle in fluid communication with the pressure chamber.

SUMMARY

The invention provides a liquid ejecting device including a channel member, an actuator, a driving-signal generating section, a voltage-set-information storing section, and a voltage applying section. The channel member is formed with a liquid channel having an ejection port for ejecting droplets. The channel member has a surface formed with an opening through which a part of the liquid channel is exposed. The actuator includes a layered body disposed on the surface of the channel member so as to confront the opening for applying energy to liquid in the opening. The layered body includes a first piezoelectric layer and a second piezoelectric layer arranged from a side closer to the surface of the channel member in this order. Each of the first and second piezoelectric layers includes an active portion in a part in confrontation with the opening. The active portion is interposed between electrodes with respect to a thickness direction. The driving-signal generating section is configured to generate driving signals for driving the actuator. The driving-signal generating section is configured to generate a first driving signal corresponding to a first voltage applied to the active portion of the first piezoelectric layer and a second driving signal corresponding to a second voltage applied to the active portion of the second piezoelectric layer. The voltage-set-information storing section stores two or more kinds of voltage sets each including a combination of the first and second voltages for each number of droplets ejected from the ejection port within a single recording period, where the single recording period is a time period required for a recording medium to move relative to the channel member by a unit distance corresponding to a resolution of an image to be recorded on the recording medium. The voltage applying section is configured to apply the first voltage to the active portion of the first piezoelectric layer and to apply the second voltage to the active portion of the second piezoelectric layer based on image data of the image. The voltage applying section is configured to select one of the two or more kinds of voltage sets stored in the voltage-set-information storing section and to apply each voltage constituting the selected voltage set to the active portions of the first and second piezoelectric layers. The voltage sets are classified by a degree of temporal overlapping of pulse-shaped voltages included in the first and second voltages.

BRIEF DESCRIPTION OF THE DRAWINGS

Embodiments in accordance with the invention will be described in detail with reference to the following figures wherein:

FIGS. 9A through 9C are explanatory diagrams of an inkjet-type printer embodying a droplet ejecting device according to a second embodiment of the invention, wherein FIG. 9A is a graph showing voltages applied to a surface electrode and an internal electrode by a certain voltage set, FIG. 9B is a graph showing electric field intensity of each piezoelectric layer generated by the certain voltage set, and FIG. 9C is a graph showing the amount of displacement of an actuator caused by the certain voltage set;

FIGS. 10A through 10C are explanatory diagrams of an inkjet-type printer embodying a droplet ejecting device according to a third embodiment of the invention, wherein FIG. 10A is a graph showing voltages applied to a surface electrode and an internal electrode by a certain voltage set, FIG. 10B is a graph showing electric field intensity of each piezoelectric layer generated by the certain voltage set, and FIG. 10C is a graph showing the amount of displacement of an actuator caused by the certain voltage set; and FIGS. 11A through 11C are explanatory diagrams of an inkjet-type printer embodying a droplet ejecting device according to a fourth embodiment of the invention, wherein FIG. 11A is a graph showing voltages applied to a surface electrode and an internal electrode by a certain voltage set, FIG. 11B is a graph showing electric field intensity of each piezoelectric layer generated by the certain voltage set, and FIG. 11C is a graph showing the amount of displacement of an actuator caused by the certain voltage set.

DETAILED DESCRIPTION

Figure 1:
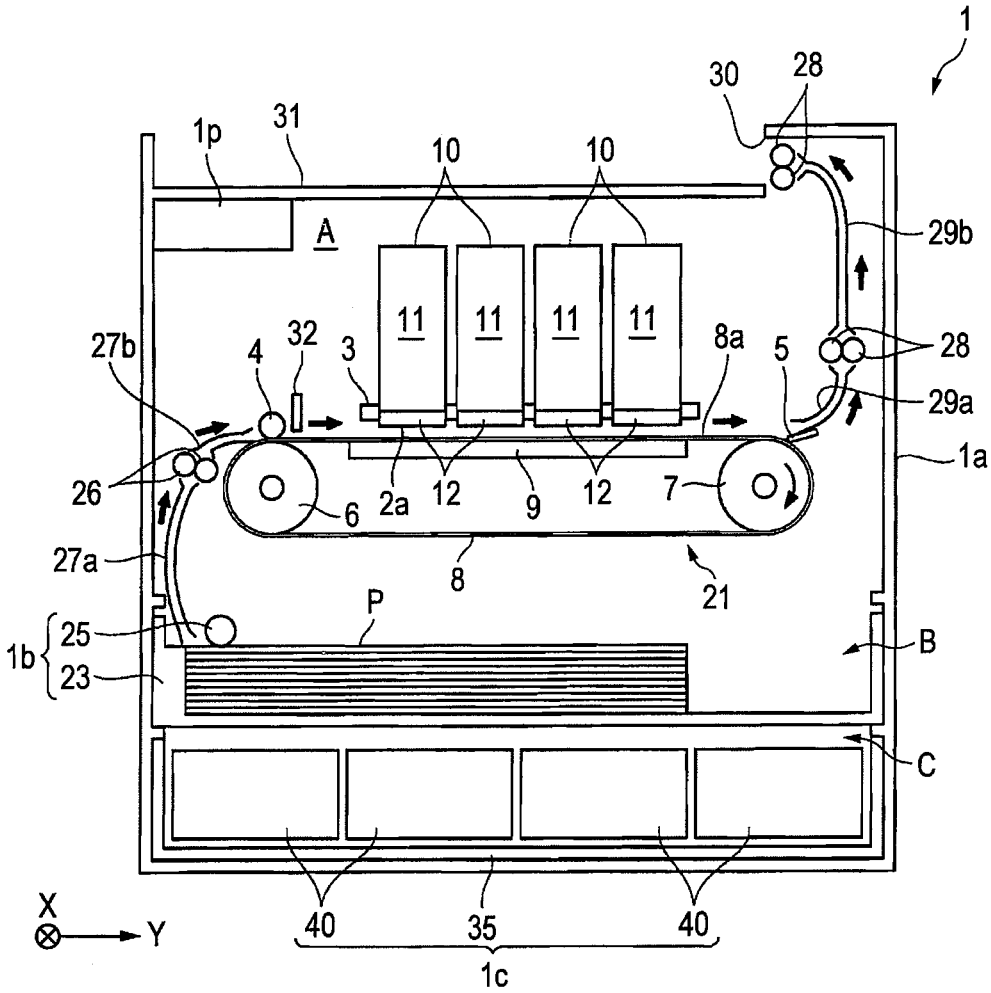
FIG. 1 is a schematic side view showing the internal structure of an inkjet-type printer embodying a droplet ejecting device according to a first embodiment of the invention.

A droplet ejecting device according to some aspects of the invention will be described while referring to the accompanying drawings. In the following description, the expressions "upper" and "lower" are used to define the various parts when the droplet ejecting device is disposed in an orientation in which it is intended to be used.

First, the overall configuration of an inkjet-type printer 1 embodying a droplet ejecting device according to a first embodiment will be described while referring to FIG. 1.

The printer 1 has a casing 1*a* having a rectangular parallelepiped shape. A paper discharging section 31 is provided on a top plate of the casing 1*a*. The internal space of the casing 1*a* is divided into spaces A, B, and C in this order from the top. The spaces A and B are spaces in which a paper conveying path leading to the paper discharging section 31 is formed. In the space A, conveyance of paper P and image formation onto paper P are performed. In the space B, operations for feeding paper are performed. In the space C, ink cartridges 40 as ink supply sources are accommodated.

Four inkjet heads 10, a conveying unit 21 that conveys paper P, a guide unit (described later) that guides paper P, and the like are arranged in the space A. A controller 1*p* is disposed at the top part of the space A. The controller 1*p* controls operations of each section of the printer 1 including these mechanisms and manages the overall operations of the printer 1.

The controller 1*p* controls a preparatory operation for image formation, operations of feeding, conveying, and discharging paper P, an ink ejecting operation in synchronization with conveyance of paper P, operations of recovering and maintaining ejection performance (maintenance operation), and the like, so that an image is formed on paper P based on image data supplied from outside.

The controller 1*p* includes a CPU (Central Processing Unit), a ROM (Read Only Memory), a RAM (Random Access Memory: including non-volatile RAM), ASIC (Application Specific Integrated Circuit), I/F (Interface), I/O (Input/Output Port), and the like. The ROM stores programs executed by the CPU, various constant data, and the like. The RAM temporarily stores data (image data, for example) that are required when the programs are executed. The ASIC performs rewriting, rearrangement, etc. of image data (signal processing and image processing). The I/F transmits data to and receives data from a higher-level device. The I/O performs input/output of detection signals of various signals. Each functioning section of the controller 1*p* is achieved by cooperation between these hardware configurations and the programs in the ROM.

Each head 10 is a line head having substantially a rectangular parallelepiped shape elongated in a main scanning direction X. The four heads 10 are arranged in a sub-scanning direction Y with a predetermined pitch, and are supported by the casing 1*a* via a head frame 3. Each head 10 includes a channel unit 12, eight actuator units 17 (see FIG. 2), and a reservoir unit 11. During image formation, ink droplets of magenta, cyan, yellow, and black colors are ejected from the lower surface (ejection surface 2*a*) of a corresponding one of the four heads 10, respectively. More specific configurations of the heads 10 will be described later in greater detail.

As shown in FIG. 1, the conveying unit 21 includes belt rollers 6 and 7, an endless-type conveying belt 8 looped around the both rollers 6 and 7, a nip roller 4 and a separation plate 5 arranged outside the conveying belt 8, a platen 9 disposed inside the conveying belt 8, and the like.

The belt roller 7 is a drive roller, and rotates by driving of a conveying motor (not shown) in the clockwise direction in FIG. 1. Rotation of the belt roller 7 causes the conveying belt 8 to move in directions shown by the thick arrows in FIG. 1. The belt roller 6 is a follow roller, and rotates in the clockwise direction in FIG. 1 by following the movement of the conveying belt 8. The nip roller 4 is disposed to confront the belt roller 6, and presses paper P supplied from an upstream-side guide section (described later) against an outer peripheral surface 8*a* of the conveying belt 8. The separation plate 5 is disposed to confront the belt roller 7, and separates paper P from the outer peripheral surface 8*a* and guides the same to a downstream-side guide section (described later). The platen 9 is disposed to confront the four heads 10, and supports an upper loop of the conveying belt 8 from the inside. With this arrangement, a predetermined gap suitable for image formation is formed between the outer peripheral surface 8*a* and the ejection surfaces 2*a* of the heads 10.

The guide unit includes the upstream-side guide section and the downstream-side guide section which are arranged with the conveying unit 21 interposed therebetween. The upstream-side guide section includes two guides 27*a* and 27*b* and a pair of feed rollers 26. The upstream-side guide section connects a paper supplying unit 1*b* (described later) and the conveying unit 21. The downstream-side guide section includes two guides 29*a* and 29*b* and two pairs of feed rollers 28. The downstream-side guide section connects the conveying unit 21 and the paper discharging section 31.

In the space B, the paper supplying unit 1*b* is disposed so as to be detachable from the casing 1*a*. The paper supplying unit 1*b* includes a paper supplying tray 23 and a paper supplying roller 25. The paper supplying tray 23 is a box which is opened upward, and can accommodate paper P in a plurality of sizes. The paper supplying roller 25 picks up paper P at the topmost position in the paper supplying tray 23 and supplies the same to the upstream-side guide section.

As described above, in the spaces A and B, a paper conveying path is formed from the paper supplying unit 1*b* via the conveying unit 21 to the paper discharging section 31. Based on a print command, the controller 1*p* drives a paper supplying motor (not shown) for the paper supplying roller 25, a feed motor (not shown) for feed rollers of each guide section, the conveying motor, and the like. Paper P sent out of the paper supplying tray 23 is supplied to the conveying unit 21 by the pair of feed rollers 26. When the paper P passes positions directly below each head 10 in the sub-scanning direction Y, ink droplets are ejected from the ejection surfaces 2*a* sequentially so that a color image is formed on the paper P. Ejecting operations of ink droplets are performed based on detection signals from a paper sensor 32. The paper P is then separated by the separation plate 5 and is conveyed upward by the two pairs of feed rollers 28. Further, the paper P is discharged onto the paper discharging section 31 through an opening 30 at the top of the apparatus.

Here, the sub-scanning direction Y is a direction parallel to the conveying direction of paper P by the conveying unit 21. The main scanning direction X is a direction parallel to a horizontal surface and perpendicular to the sub-scanning direction Y.

In the space C, an ink unit 1*c* is disposed so as to be detachable from the casing 1*a*. The ink unit 1*c* includes a cartridge tray 35 and four cartridges 40 arranged side by side within the cartridge tray 35. Each cartridge 40 supplies ink to a corresponding one of the heads 10 via an ink tube (not shown).

The configuration of the heads 10 will be described in greater detail with reference to FIGS. 2 through 5. Note that, in FIG. 3, pressure chambers 16 and apertures 15 are located below the actuator units 17 and should be strictly shown in dotted lines, but these are shown in the solid lines for simplicity in FIG. 3.

Figure 5:
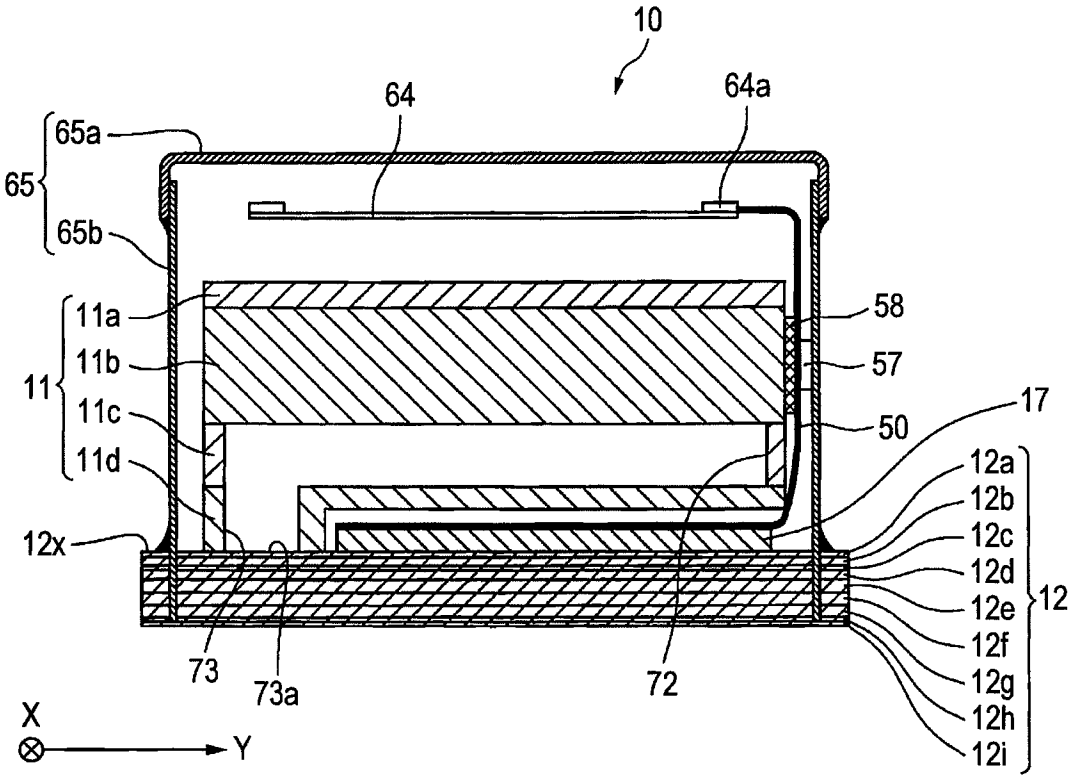
FIG. 5 is a vertical cross-sectional view of the inkjet head.

As shown in FIG. 5, the head 10 is a layered body in which the channel unit 12, the actuator unit 17, the reservoir unit 11, and a board 64 are stacked. Among these, the actuator unit 17, the reservoir unit 11, and the board 64 are accommodated in a space defined by an upper surface 12*x* of the channel unit 12 and a cover 65. In this space, a FPC (flat flexible print circuit board) 50 electrically connects the actuator unit 17 and the board 64. A driver IC 57 is mounted on the FPC 50.

As shown in FIG. 5, the cover 65 includes a top cover 65*a* and a side cover 65*b*. The cover 65 is a box which is opened downward, and is fixed to the upper surface 12*x* of the channel unit 12. Silicone materials are filled in the boundary between the both covers 65*a* and 65*b* and in the boundary between the side cover 65*b* and the upper surface 12*x*. The side cover 65*b* is made of an aluminum plate and also functions as a heat-sink. The driver IC 57 abut on the inner surface of the side cover 65*b* and is thermally coupled to the side cover 65*b*. Note that, in order to ensure the thermal coupling, the driver IC 57 is urged by an elastic member 58 (for example, a sponge) fixed to the side surface of the reservoir unit 11 toward the side cover 65*b* side.

The reservoir unit 11 is a layered body in which four metal plates 11*a*-11*d* formed with through holes and concave portions are bonded with one another. An ink channel is formed inside the reservoir unit 11. The plate 11*c* is formed with a reservoir 72 that temporarily stores ink. One end of the ink channel is connected to the cartridge 40 via a tube or the like, whereas the other end opens in the lower surface of the reservoir unit 11. As shown in FIG. 5, the lower surface of the plate 11*d* is formed with concavities and convexities. The concavities provide spaces between the plate 11*d* and the upper surface 12*x*. The actuator unit 17 is fixed to the upper surface 12*x* in this space. A certain gap is formed between the concavities of the lower surface of the plate 11*d* and the FPC 50 on the actuator unit 17. The plate 11*d* is formed with an ink outflow channel 73 (a part of the ink channel of the reservoir unit 11) in fluid communication with the reservoir 72. The ink outflow channel 73 opens in an end surface of the convex portion of the lower surface of the plate 11*d* (that is, the surface bonded with the upper surface 12*x*).

Figure 2:
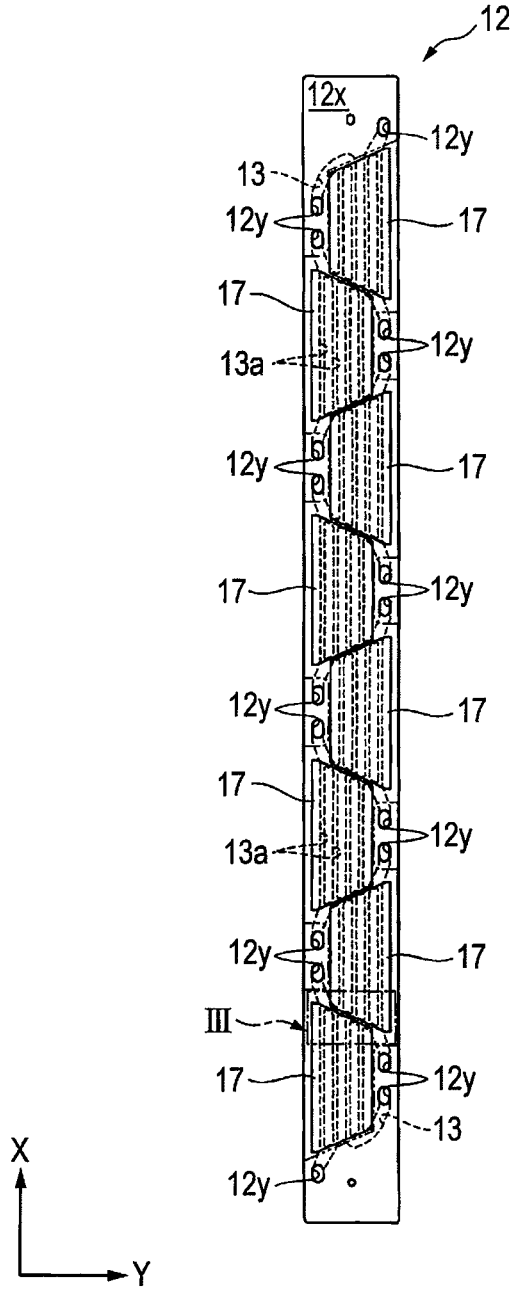
FIG. 2 is a plan view showing a channel unit and actuator units of an inkjet head included in the printer of FIG. 1.
Figure 3:
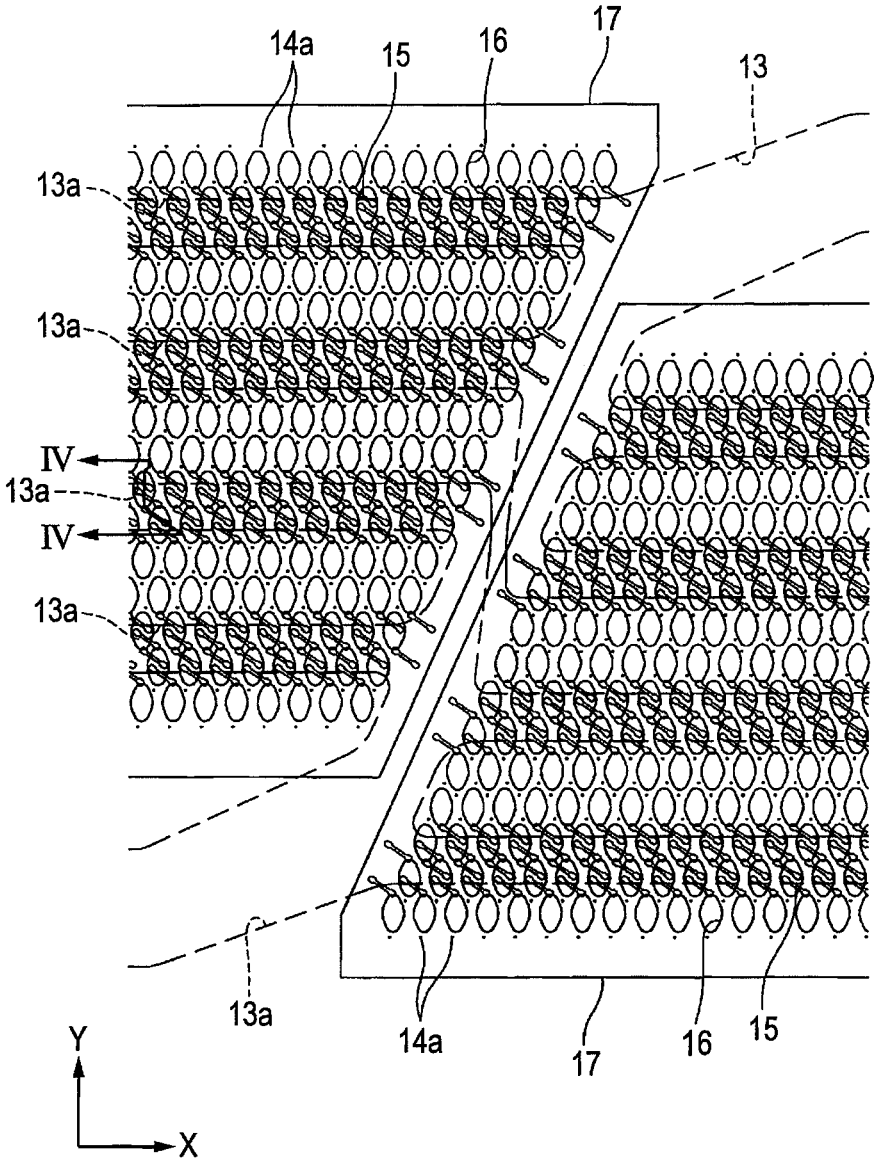
FIG. 3 is an enlarged view showing a region III surrounded by the single-dot chain line in FIG. 2.
Figure 4:
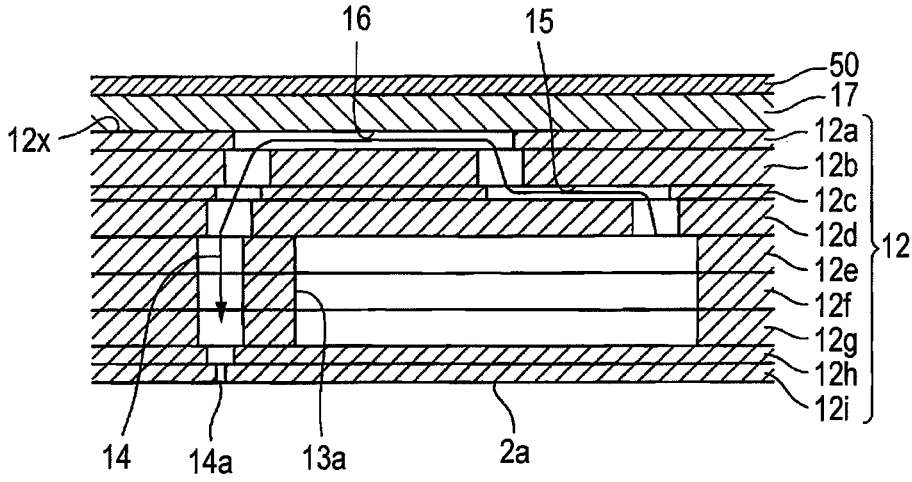
FIG. 4 is a partial cross-sectional view along a line IV-IV in FIG. 3.

The channel unit 12 is a layered body in which nine rectangular-shaped metal plates 12*a*, 12*b*, 12*c*, 12*d*, 12*e*, 12*f*, 12*g*, 12*h*, and 12*i* having substantially the same size (see FIG. 4) are bonded with one another. As shown in FIG. 2, the upper surface 12*x* of the channel unit 12 is formed with openings 12*y* in confrontation with a corresponding one of openings 73*a* of the ink outflow channel 73. Within the channel unit 12, ink channels are formed to connect from the openings 12*y* to ejection ports 14*a*. As shown in FIGS. 2, 3, and 4, the ink channel includes a manifold channel 13 having the opening 12*y* at one end thereof, subsidiary manifold channels 13*a* branching off from the manifold channel 13, and individual ink channels 14 running from outlets of the subsidiary manifold channels 13*a* via the pressure chambers 16 to the ejection ports 14*a*. As shown in FIG. 4, the individual ink channel 14 is formed for each ejection port 14*a*, and includes an aperture 15 functioning as an aperture for adjusting channel resistance. In addition, a large number of the pressure chambers 16 opens in the upper surface 12*x*. The opening of each pressure chamber 16 has substantially a diamond shape. The openings of the pressure chambers 16 are arranged in a matrix configuration so as to form a total of eight pressure-chamber groups each occupying substantially a trapezoidal region in a plan view. Like the pressure chambers 16, the ejection ports 14*a* opening in the ejection surface 2*a* are arranged in a matrix configuration so as to form a total of eight ejection-port groups each occupying substantially a trapezoidal region in a plan view.

As shown in FIG. 2, each actuator unit 17 has a trapezoidal shape in plan view. The actuator units 17 are arranged in a staggered configuration (in two rows) on the upper surface 12*x* of the channel unit 12. Further, as shown in FIG. 3, each actuator unit 17 is arranged on a trapezoidal region occupied by a pressure-chamber group (ejection-port group). For each of the actuator units 17, the lower base of a trapezoidal shape is located adjacent to an end of the channel unit 12 in the sub-scanning direction Y. The actuator units 17 are arranged so as to avoid a convex portion of the lower surface of the reservoir unit 11. The lower base of the trapezoidal shape of each actuator unit 17 is interposed between the openings 12*y* (the opening 73*a*) from the both sides in the main scanning direction X.

The FPC 50 is provided for each actuator unit 17. Wiring corresponding to each electrode of the actuator unit 17 is connected to a corresponding one of the output terminals of the driver IC 57. Under controls by the controller 1*p* (see FIG. 1), the FPC 50 transmits various driving signals adjusted in the board 64 to the driver IC 57, and transmits each driving potential generated by the driver IC 57 to the actuator unit 17. The driving potential is selectively applied to each electrode of the actuator unit 17.

Next, the configuration of the actuator unit 17 will be described with reference to FIGS. 6A through 6C.

Figure 6A:
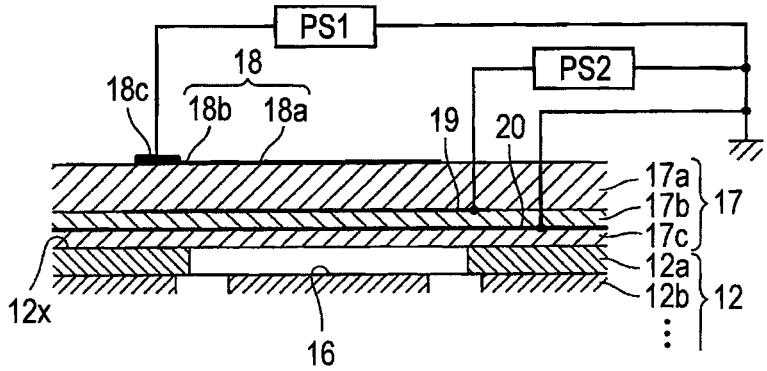
FIG. 6A is a partial cross-sectional view showing one of the actuator units of FIG. 2.

As shown in FIG. 6A, the actuator unit 17 includes a layered body of two piezoelectric layers 17*a* and 17*b*, and a vibration plate 17*c* arranged between the layered body and the channel unit 12. The piezoelectric layers 17*a* and 17*b* and the vibration plate 17*c* are all sheet-like members made of ceramic materials of lead zirconate titanate (PZT) series having ferroelectricity. The piezoelectric layers 17*a* and 17*b* and the vibration plate 17*c* have the same size and shape (trapezoidal shape) as viewed in the thickness direction of the piezoelectric layers 17*a* and 17*b* (the stacking direction in which the piezoelectric layers 17*a* and 17*b* are stacked). The vibration plate 17*c* seals openings of a pressure-chamber group (a large number of the pressure chambers 16) formed in the upper surface 12*x* of the channel unit 12. The thickness of the piezoelectric layer 17*a*, which is the outermost layer, is greater than a sum of the thickness of the piezoelectric layer 17*b* and the thickness of the vibration plate 17*c*. The piezoelectric layers 17*a* and 17*b* are polarized in the same direction along the stacking direction.

The upper surface of the piezoelectric layer 17*a* is formed with a large number of surface electrodes 18 corresponding to the respective ones of the pressure chambers 16. An internal electrode 19 is formed between the piezoelectric layer 17*a* and the piezoelectric layer 17*b* under the piezoelectric layer 17*a*. A common electrode 20 is formed between the piezoelectric layer 17*b* and the vibration plate 17*c* under the piezoelectric layer 17*b*. No electrode is formed on the lower surface of the vibration plate 17*c*. In the present embodiment, the internal electrode 19 is formed on the upper surface of the piezoelectric layer 17*b*, and the common electrode 20 is formed on the upper surface of the vibration plate 17*c*.

Figure 6B:
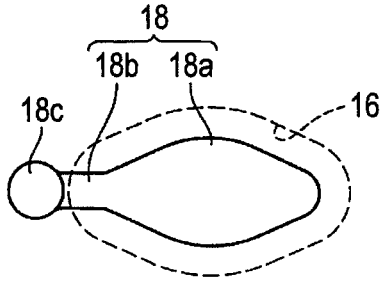
FIG. 6B is a plan view showing a surface electrode included in the actuator unit.

As shown in FIG. 6B, each surface electrode 18 includes a main electrode region 18*a* having substantially a diamond shape, an extension portion 18*b* extending from one of the acute angles of the main electrode region 18*a*, and a land 18*c* formed on the extension portion 18*b*. The shape of the main electrode region 18*a* is a similarity shape to that of the opening of the pressure chamber 16, while the size of the main electrode region 18*a* is smaller than that of the opening of the pressure chamber 16. In a plan view, the main electrode region 18*a* is arranged within the opening of the pressure chamber 16. The extension portion 18*b* extends to a region outside of the opening of the pressure chamber 16, and the land 18*c* is arranged at a distal end of the extension portion 18*b*. The land 18*c* has a circular shape in a plan view, and does not confront the pressure chamber 16. The land 18*c* has a height of approximately 50 μm (micrometers) from the upper surface of the piezoelectric layer 17*a*. The land 18*c* is electrically connected to an electrode of wiring of the FPC 50. The piezoelectric layer 17*a* and the FPC 50 confront each other with a gap of approximately 50 μm (micrometers), at regions except the electrical connection point. With this configuration, free deformation of the actuator units 17 can be ensured.

The internal electrode 19 is an electrode for controlling tones. As shown in FIG. 6C, the internal electrode 19 includes a large number of individual electrodes 19*a* that confronts the respective ones of the openings of the pressure chambers 16, and a large number of connection electrodes 19*b* that connects the individual electrodes 19*a* with one another.

The shape of each individual electrode 19*a* is a similarity shape to that of the opening of the pressure chamber 16 as viewed in the stacking direction of the piezoelectric layers 17*a* and 17*b*. The size of the individual electrode 19*a* is larger than that of the opening of the pressure chamber 16. In a plan view, the individual electrode 19*a* includes the opening of the pressure chamber 16 therein.

The individual electrodes 19*a* are arranged at regular intervals along the longitudinal direction of the head 10 (the main scanning direction X) on the upper surface of the piezoelectric layer 17*b*, thereby constituting a plurality of individual-electrode rows. These individual-electrode rows are parallel to one another. The individual electrodes 19*a* are arranged in a staggered configuration along the main scanning direction X, and constitutes sixteen (16) individual-electrode rows.

The connection electrodes 19*b* connect the plurality of individual electrodes 19*a* with one another. As shown in FIG. 3, the pressure chambers 16 constitute a plurality of pressure-chamber rows along the main scanning direction X, where four pressure-chamber rows share one subsidiary manifold channel 13*a*. The plurality of individual electrodes 19*a* corresponding to the four pressure-chamber rows are connected with one another by the connection electrodes 19*b*. As shown in FIG. 6C, the connection electrodes 19*b* connect the individual electrodes 19*a* with one another along individual-electrode rows. In addition, the connection electrodes 19*b* connect the individual electrodes 19*a* with one another along oblique sides of the diamond shapes, straddling the individual-electrode rows. The connection electrodes 19*b* are linear-shaped electrodes.

The common electrode 20 is an electrode shared by all the pressure chambers 16 corresponding to one actuator unit 17. The common electrode 20 is formed on the entire surface of the vibration plate 17*c*. With this configuration, an electric field that is generated in each of the piezoelectric layers 17*a* and 17*b* is insulated against the pressure chamber 16 side. The common electrode 20 is always kept at a ground potential.

The upper surface of the piezoelectric layer 17*a* is formed with a land for the internal electrode (not shown) and a land for the common electrode (not shown), in addition to the land 18*c* for the surface electrode. The land for the internal electrode is electrically connected to the internal electrode 19 via a through hole of the piezoelectric layer 17*a*. The land for the common electrode is electrically connected to the common electrode 20 via a through hole penetrating the piezoelectric layers 17*a* and 17*b*. In the upper surface of the piezoelectric layer 17*a*, the land for the internal electrode is arranged at substantially the center of each side of a trapezoidal shape, while the land for the common electrode is arranged near each corner of a trapezoidal shape. Each land is connected with a terminal of the FPC 50. Among these, the land for the common electrode is connected with a wiring connected to ground, and the land for the internal electrode is connected with a wiring extending from the output terminal of the driver IC 57.

A part of each of the piezoelectric layers 17*a* and 17*b* functions as an active portion, the part being interposed between the electrodes 18, 19, and 20. The actuator unit 17 provides energy to ink within the pressure chamber 16 by deformation of the active portions of the piezoelectric layers 17*a* and 17*b* stacked vertically, the active portions being located at the position in confrontation with the opening of each pressure chamber 16 in a corresponding pressure-chamber group. The active portions stacked vertically are provided for each pressure chamber 16, and are capable of deforming independently for each pressure chamber 16. That is, the actuator unit 17 includes a piezoelectric-type actuator for each pressure chamber 16. Each active portion is displaced in at least one vibration mode selected from among $d_{31}$, $d_{33}$, and $d_{15}$ ($d_{31}$ in the present embodiment). A part of the vibration plate 17*c* does not deform by itself even when an electric field is applied, the part confronting the active portion in the stacking direction (inactive portion). In this way, the actuator of the present embodiment is a piezoelectric actuator of so-called unimorph type, where two active portions and one inactive portion are stacked. For example, looking only at the piezoelectric layer 17*a*, which is the uppermost layer, if an electric field is applied in the same direction as the polarizing direction, the active portion of the piezoelectric layer 17*a* contracts in the surface direction by the piezoelectric lateral effect. However, the piezoelectric layer 17*b* and the vibration plate 17*c* do not deform by themselves, and function as layers that restrict displacement of the active portion of the piezoelectric layer 17*a*. At this time, because difference in deformation occurs between the both (the actuator unit 17, and the piezoelectric layer 17*b* and the vibration plate 17*c*), the actuator as a whole deforms to be convex toward the pressure chamber 16. It can be said that each actuator is a layered body of two unimorph-type piezoelectric elements sharing the vibration plate 17*c*.

Next, controls for driving each actuator of the actuator unit 17 during recording will be described with reference to FIGS. 7A through 8E.

In the present embodiment, it is assumed that, at recording, the piezoelectric layer 17*a* is displaced in the vibration mode $d_{31}$, and a so-called "pull and eject method" in which ink is supplied to the pressure chamber 16 prior to ejection of an ink droplet. First, this will be described in details.

Before the controller 1*p* receives a print command, the electric potentials of all the surface electrodes 18 are kept at a high level (15V, for example), whereas the electric potentials of the internal electrode 19 and the common electrode 20 are kept at a low level (ground potential: 0V). Thus, it is kept at a state that all the actuators of the actuator unit 17 are deformed to be convex toward the pressure chambers 16, so that the volume of the pressure chamber 16 is V1 (see FIG. 7A). On receiving a print command, the controller 1*p* starts application of voltages based on image data. First, the surface electrode 18 is made to be ground potential which is the same as the common electrode 20. At this time the volume of the pressure chamber 16 increases from V1 to V2 (see FIGS. 7A and 7B), and supplying of ink is started from the subsidiary manifold channel 13*a* to the pressure chamber 16. After that, at the time when ink for supply reaches the pressure chamber 16, the surface electrode 18 is returned to an electric potential (15V, for example) different from that of the common electrode 20. At this time, the actuator deforms to be convex toward the pressure chamber 16 (see FIG. 7C). Hence, because the volume of the pressure chamber 16 decreases from V2 to V1 and pressure is applied to ink within the pressure chamber 16, the ink is ejected from the ejection port 14*a* as an ink droplet.

The above-described series of operations including supplying of ink to the pressure chamber 16 and ejection of an ink droplet from the ejection port 14*a* is repeated by the number of times which is the same as the number of ink droplets to be ejected, within one recording cycle (a time period required for paper P to move relative to the head 10 by a unit distance corresponding to the resolution of an image to be recorded on the paper P). For example, if the driving frequency is 20 kHz, the recording cycle is 50 μs (microseconds).

Next, a tone control using the above-described pull and eject method will be described.

The controller 1*p* generates driving signals for driving the actuator unit 17 based on image data. The driving signals include ejection driving signals and non-ejection driving signals. The ejection driving signal is a signal that, with only this signal, can cause an ink droplet to be ejected from the ejection port 14*a*, if it is amplified to a predetermined voltage. The non-ejection driving signal is a signal that, with only this signal, cannot cause an ink droplet to be ejected from the ejection port 14*a*, even if it is amplified to the predetermined voltage. The non-ejection driving signal causes a meniscus formed in the ejection port 14*a* to vibrate without ejecting an ink droplet from the ejection port 14*a*.

The driver IC 57 amplifies each of the ejection driving signal and the non-ejection driving signal generated as described above, and generates an ejection driving voltage and a non-ejection driving voltage. Then, the driver IC 57 applies the ejection driving voltage to the surface electrodes 18, and applies the non-ejection driving voltage to the internal electrode 19. The common electrode 20 is always kept at ground potential (0V). Thus, the ejection driving voltage is applied to the active portion (between the surface electrode 18 and the internal electrode 19) of the piezoelectric layer 17*a*, and the non-ejection driving voltage is applied to the active portion (between the internal electrode 19 and the common electrode 20) of the piezoelectric layer 17*b*.

The number of sets of the ejection driving voltage and the non-ejection driving voltage applied within one recording cycle (voltage sets) equals to the number corresponding to the number of tones. The number of tones indicates the number of kinds of an amount of ink droplets for forming one pixel (ink droplets to be ejected from one ejection port 14*a* within one recording cycle). In the present embodiment, the number of tones is seven tones, that is, there are seven kinds of the amount of ink droplets of zero (0), small S, small L, middle S, middle L, large S, and large L. Here, "zero", "small", "middle", and "large" indicate that the number of ink droplets forming one pixel (hereinafter, simply referred to as "pixel droplet number") is 0, 1, 2, and 3, respectively. Further, "S" indicates that the size of one droplet is small, and "L" indicates that the size of one droplet is large. In other words, in the present embodiment, there are two kinds ("S" and "L") of voltage sets for each of pixel droplet numbers of 1, 2, and 3 (except "zero"), which makes a total of seven voltage sets. The controller 1*p* selects one of the above-explained seven voltage sets for each recording cycle, and applies the ejection driving voltage and the non-ejection driving voltage constituting the voltage set to the surface electrode 18 and the internal electrode 19, respectively.

Information on these voltage sets is stored in the ROM of the controller 1*p*.

The two kinds of voltage sets provided for each pixel droplet number (the voltage sets of small S and small L, middle S and middle L, and large S and large L) are classified by a degree of temporal overlapping of pulse-shaped voltages included in each voltage constituting the voltage set. The pulse-shaped voltages are rectangular-shaped and pulse-shaped voltage changing parts that are defined by a rising edge and a falling edge having a time width (pulse width) therebetween. The pulse-shaped voltages will be hereinafter referred to as "pulse voltages". This will be described in detail, taking a voltage set of small S and small L provided for the case of the pixel droplet number=1 as an example.

Figure 8A:
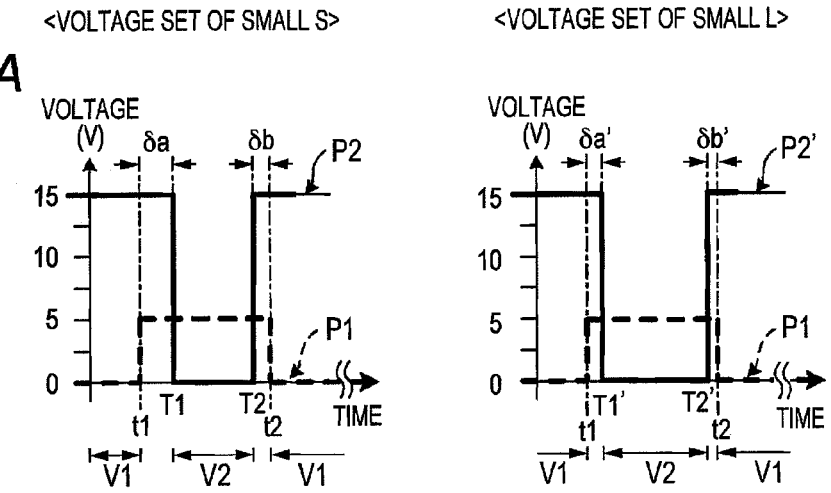
FIG. 8A includes graphs showing voltages applied to the surface electrode and the internal electrode by each voltage set of small S and small L.

The voltage set of small S shown in the left-side of FIG. 8A consists of a combination of a non-ejection driving voltage P1 and an ejection driving voltage P2. The voltage set of small L shown in the right-side of FIG. 8A consists of a combination of the non-ejection driving voltage P1 and an ejection driving voltage P2'. In the voltage set of small S and small L, the non-ejection driving voltage P1 is common, whereas the ejection driving voltages P2 and P2' are different from each other. The non-ejection driving voltage P1 includes three pulse voltages that change between a low level (0V: ground potential) and a high level (5V, for example) with a predetermined pulse width therebetween. Note that FIG. 8A shows only the first pulse voltage that is applied earliest among the three pulse voltages. Each of the ejection driving voltages P2 and P2' includes one pulse voltage that changes between a high level (15V, for example) and a low level (0V: ground potential) with a predetermined pulse width therebetween.

In the voltage set of small S, the high level of the first pulse voltage of the non-ejection driving voltage P1 and the high level of the pulse voltage of the ejection driving voltage P2 overlap during a time period between time point t1 and time point T1 and during a time period between time point T2 and time point t2. In the voltage set of small L, the high level of the first pulse voltage of the non-ejection driving voltage P1 and the high level of the pulse voltage of the ejection driving voltage P2' overlap during a time period between time point t1 and time point T1' and during a time period between time point T2' and time point t2.

In the present embodiment, as shown in FIG. 6A, there are provided two driving power sources PS1 and PS2. The driving power source PS1 includes a part of the driver IC 57 that outputs pulse voltages of 15V. One end of the driving power source PS1 is connected to ground. The driving power source PS2 includes another part of the driver IC 57 that outputs pulse voltages of 5V. One end of the driving power source PS2 is connected to ground. Hence, in the example of FIGS. 8A through 8C, during the temporal overlapping parts of the pulse voltages, that is, during a time period from time point t1 to time point T1 or T1' and during a time period from time point T2 or T2' to time point t2, electric field intensity due to a voltage of 10 (=15−5) V is generated in the piezoelectric layer 17*a* (see FIG. 8B).

Note that, in the voltage sets of small S and small L, two pulse voltages, included in the non-ejection driving voltage P1, other than the above-mentioned first pulse voltage are not shown in the drawing. The two pulse voltages are applied after time point t2 within the recording cycle during a period in which the ejection driving voltage P2 or P2' is not applied.

Figure 8B:
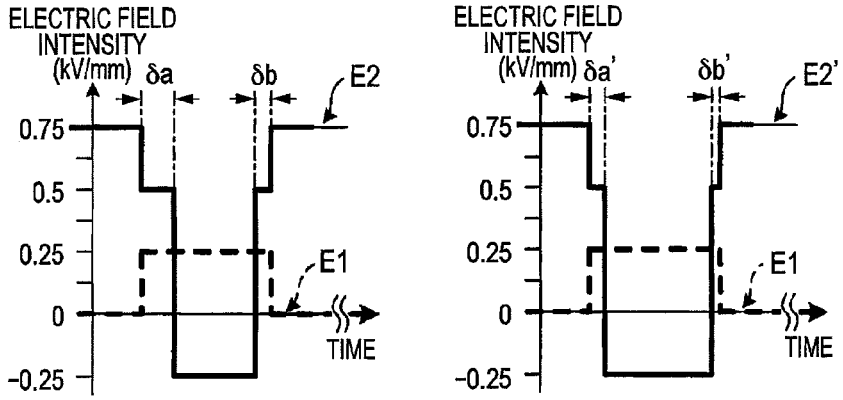
FIG. 8B includes graphs showing electric field intensity of each piezoelectric layer generated by each voltage set.
Figure 8C:
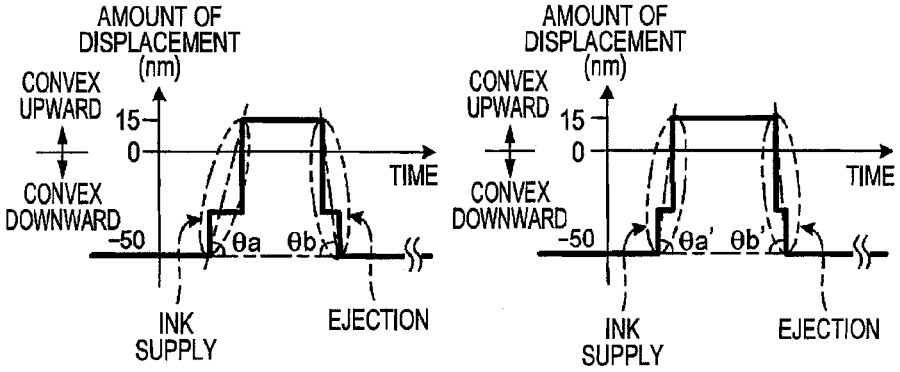
FIG. 8C includes graphs showing the amount of displacement of the actuator generated by each voltage set.

Time point t1 is a time point when the pulse voltage of the non-ejection driving voltage P1 rises and when the active portion of the piezoelectric layer 17*b* starts deforming so that the volume of the pressure chamber 16 starts decreasing. At this point, the electric potential of the surface electrode 18 (here, 15V relative to ground potential) does not change. However, with an increase of the electric potential of the internal electrode 19 (here, an increase of 5V from ground potential), voltage applied to the active portion of the piezoelectric layer 17*a* (potential difference between the surface electrode 18 and the internal electrode 19) decreases by the amount of voltage applied to the piezoelectric layer 17*b* (here, 5V). That is, this is also a time point when the piezoelectric layer 17*a* starts changing so as to increase the volume of the pressure chamber 16. At this time, a change of the piezoelectric layer 17*a* is predominant and, as shown in FIG. 8C, the volume of the pressure chamber 16 increases. This volumetric change is a change associated with a change (increase) in the pulse voltage of the non-ejection driving voltage P1. Note that, as shown in FIG. 8B, an electric field in the same direction as the polarizing direction is generated in the both piezoelectric layers 17*a* and 17*b*, in accordance with electric potentials of the surface electrode 18 and the internal electrode 19.

Time point T1 or T1' is a time point when the pulse voltage of the ejection driving voltage P2 or P2' falls and when the actuator (the active portion of the piezoelectric layer 17*a*) starts deforming based on the ejection driving voltage so that the volume of the pressure chamber 16 starts increasing. At this point, the electric potential of the internal electrode 19 (here, 5V relative to ground potential) does not change, and voltage applied to the piezoelectric layer 17*b* is kept at 5V. On the other hand, the surface electrode 18 becomes ground potential. At this time, the volume of the pressure chamber 16 changes by the change amount of voltage applied to the piezoelectric layer 17*a* and, as shown in FIG. 8C, the volume of the pressure chamber 16 increases. This volumetric change is a change associated with a change (decrease) in the pulse voltage of the ejection driving voltage P2 or P2'. In the present embodiment, an electric field in the opposite direction from the polarizing direction is generated in the piezoelectric layer 17*a*, and an electric field in the same direction as the polarizing direction is generated in the piezoelectric layer 17*b*, in accordance with an electric potential of the internal electrode 19. The voltage applied to each of the piezoelectric layers 17*a* and 17*b* is the same, which is 5V. At this time, a change of the piezoelectric layer 17*a* is predominant. As shown in FIG. 8C, the volume of the pressure chamber 16 increase slightly, compared with the case in which no voltage is applied to either piezoelectric layer 17*a* or 17*b*.

Time point T2 or T2' is a time point when the pulse voltage of the ejection driving voltage P2 or P2' rises and when the active portion of the piezoelectric layer 17*a* starts deforming based on the ejection driving voltage so that the volume of the pressure chamber 16 starts decreasing. At this point, the electric potential of the internal electrode 19 does not change, and voltage applied to the piezoelectric layer 17*b* is kept at 5V. On the other hand, the surface electrode 18 becomes an electric potential of 15V. At this time, an electric field in the same direction as the polarizing direction is generated in the both piezoelectric layers 17*a* and 17*b*, in accordance with electric potentials of the surface electrode 18 and the internal electrode 19. The piezoelectric layer 17*a* is applied with voltage (potential difference between the surface electrode 18 and the internal electrode 19) of 10V and, as shown in FIG. 8C, the volume of the pressure chamber 16 decreases. This volumetric change is a change associated with a change (increase) in the pulse voltage of the ejection driving voltage P2 or P2'. The volume of the pressure chamber 16 is the same as when the pulse voltage of the non-ejection driving voltage P1 is applied at time point t1.

Time point t2 is a time point when the pulse voltage of the non-ejection driving voltage P1 falls and when the active portion of the piezoelectric layer 17*b* starts deforming based on the non-ejection driving voltage so that the volume of the pressure chamber 16 starts increasing. At this point, the electric potential of the surface electrode 18 does not change. On the other hand, the electric potential of the internal electrode 19 becomes ground potential. As shown in FIG. 8B, the active portion of the piezoelectric layer 17*a* is applied with voltage (potential difference between the surface electrode 18 and the internal electrode 19) of 15V. That is, this is also a time point when the piezoelectric layer 17*a* starts changing so as to decrease the volume of the pressure chamber 16. At this time, a change of the piezoelectric layer 17*a* is predominant and, as shown in FIG. 8C, the volume of the pressure chamber 16 decreases. This volumetric change is a change associated with a change (decrease) in the pulse voltage of the non-ejection driving voltage P2 or P2'.

Figure 7A:
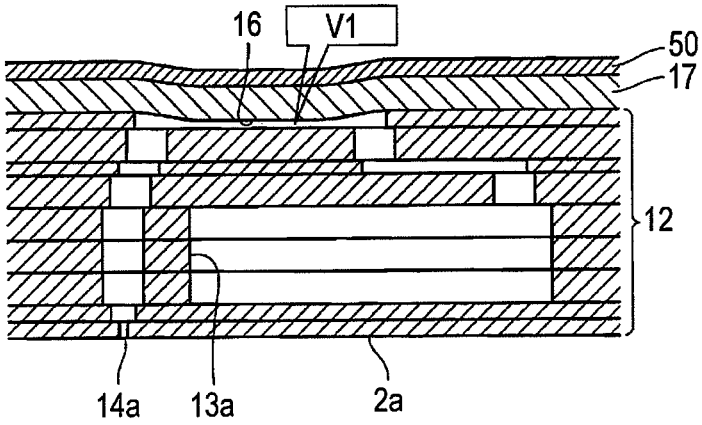
FIGS. 7A through 7C are views for showing a driving operation of an actuator during recording.
Figure 7B:
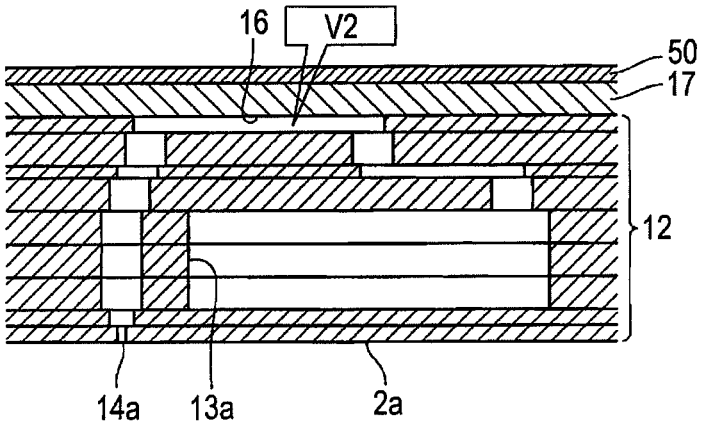
Figure 7C:
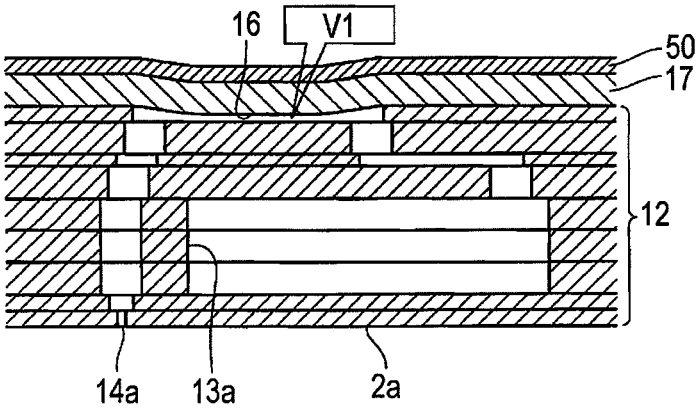

A period prior to time point t1 corresponds to the state where the volume of the pressure chamber 16 is volume V1 (see FIG. 7A). A period from time point T1 (T1') to time point T2 (T2') corresponds to the state where the volume of the pressure chamber 16 is volume V2 (see FIG. 7B). A period after time point t2 corresponds to the state where the volume of the pressure chamber 16 is volume V1 (see FIG. 7C). Ink is supplied into the pressure chamber 16 by a change in voltage from time point t1 to time point T1 or T1', and an ink droplet is ejected by a change in voltage from time point T2 or T2' to time point t2 (see FIG. 8C).

Note that a volumetric change of the pressure chamber 16 (a change from volume V1 to volume V2, or a change from volume V2 to volume V1) does not occur instantaneously. As shown in FIG. 8C, the volume of the pressure chamber 16 is between volume V1 and volume V2 during a period from time point t1 to time point T1 or T1' and during a period from time point T2 or T2' to time point t2. During these periods, as shown in FIG. 8B, the piezoelectric layer 17*a* is applied with an electric field corresponding to voltage of 10 (=15−5) V, and the piezoelectric layer 17*b* is applied with an electric field corresponding to voltage of 5V. For the overall deformation of the actuator, the influence due to a change of the piezoelectric layer 17*a* is predominant, compared with a change of the piezoelectric layer 17*b*. Hence, the volume of the pressure chamber 16 during these periods is substantially the same as the volume when an electric field by voltage of 10 (=15−5) V is applied to the active portion of the piezoelectric layer 17*a*. Further, during a period from time point T1 or T1' to time point T2 or T2', an electric field corresponding to voltage 5V is generated in the piezoelectric layer 17*a* in the opposite direction from the polarizing direction, and an electric field corresponding to voltage 5V is generated in the piezoelectric layer 17*b* in the same direction as the polarizing direction. Hence, the actuator is deformed to be slightly concave toward the pressure chamber 16.

In the voltage sets of small S and small L, time point T1 and time point T1' are different, and time point T2 and time point T2' are also different. Specifically, time point T1 is at a later timing than time point T1', and time point T2 is at an earlier timing than time point T2'. Hence, time difference δ*a'* between time point t1 and time point T1' in the voltage set of small L is smaller than time difference δa between time point t1 and time point T1 in the voltage set of small S. Similarly, time difference δb' between time point T2' and time point t2 in the voltage set of small L is smaller than time difference δb between time point T2 and time point t2 in the voltage set of small S.

In the present embodiment, the time difference (pulse width) between time point T1' and time point T2' in the voltage set of small L is closer to AL (Acoustic Length: time length of one-way propagation of a pressure wave in the individual ink channel 14) than the time difference (pulse width) between time point T1 and time point T2 in the voltage set of small S is. Thus, the voltage set of small L is easier to eject larger ink droplets. Further, also because of the fact that time difference δa' is smaller than time difference δa, the voltage set of small L is easier to eject larger ink droplets. In this way, it is so designed that the voltage set of small L is easier to eject larger ink droplets than the voltage set of small S from the both aspects of the pulse width and the time of a change of pulse voltage.

As shown in FIGS. 8A through 8C, electric field intensities E2 and E2' generated in the piezoelectric layer 17*a* (see the solid lines of FIG. 8B) and the amounts of displacement of the actuator (see FIG. 8C) have temporal change patterns that are different between the voltage set of small S and the voltage set of small L, due to differences of these time differences ϵa, ϵa'; ϵb, ϵb' (the degree of temporal overlapping of pulse voltages). Note that, because the non-ejection driving voltage P1 is common between the voltage set of small S and the voltage set of small L, the temporal change pattern of electric field intensity E1 generated in the piezoelectric layer 17*b* is the same.

The difference in the change pattern of the amount of displacement of the actuator will be described in detail. Effective displacement velocities of the actuator during ink supply and during ejection (angles θa, θa'; θb, θb' shown in FIG. 8C) is different between the voltage set of small S and the voltage set of small L, due to the difference of time differences δa, δa'; δb, δb'. The angle θa is smaller than the angle θa', and the angle θb is smaller than the angle θb'. In this way, the displacement velocity of the actuator during ink supply and during ejection is smaller in the voltage set of small S than in the voltage set of small L, and thus the size of ejected ink droplets is smaller in the voltage set of small S than in the voltage set of small L.

Explanation has been provided for the difference between two kinds of voltage sets provided for each pixel droplet number, taking the voltage sets of small S and small L for the pixel droplet number=1 as an example. Similar explanation can be applied to voltage sets for the pixel droplet number=2 and 3 (middle S and middle L, and large S and large L). In other words, each of the voltage sets of middle S, middle L, large S, and large L consists of a combination of the non-ejection driving voltage P1 and an ejection driving voltage. The non-ejection driving voltage P1 is used commonly for all of seven voltage sets (the voltage sets of zero, small S, small L, middle S, middle L, large S, and large L). The ejection driving voltages are different between the voltage sets of middle S and middle L, and are also different between the voltage sets of large S and large L. The number of pulse voltages included in each ejection driving voltage is the same as the pixel droplet number. That is, the ejection driving voltage includes two pulse voltages for the case of the pixel droplet number=2 (middle S and middle L), and includes three pulse voltages for the case of the pixel droplet number=3 (large S and large L). In each voltage set of the pixel droplet number=2 (middle S and middle L), two pulse voltages included in the ejection driving voltage have temporal overlapping with the first and second pulse voltages included in the non-ejection driving voltage P1, respectively. In each voltage set of the pixel droplet number=3 (large S and large L), three pulse voltages included in the ejection driving voltage have temporal overlapping with the three pulse voltages included in the non-ejection driving voltage P1, respectively. For each pixel droplet number, the voltage sets are classified by a degree of this temporal overlapping.

In the present embodiment, the voltage set of middle S is a combination of the voltage P1 and a voltage including two pulse voltages of voltage P2, and the voltage set of middle L is a combination of the voltage P1 and a voltage including two pulse voltages of voltage P2'. Similarly, the voltage set of large S is a combination of the voltage P1 and a voltage including three pulse voltages of voltage P2, and the voltage set of large L is a combination of the voltage P1 and a voltage including three pulse voltages of voltage P2'. The voltage P1 is common for each voltage set.

The ejection driving voltage constituting each voltage set may include a cancel pulse. The cancellation pulse is a pulse voltage for attenuating residual pressure wave generated in the ink channel by ejection of ink droplets in the current recording cycle. Application of the cancellation pulse can help stabilize ejection of ink droplets in the subsequent recording cycle. For example, in each voltage set, a cancellation pulse may be applied in a predetermined time period after application of three pulse voltages of the non-ejection driving voltage P1. The cancellation pulse may be included in either the ejection driving voltage or the non-ejection driving voltage.

As described above, according to the printer 1 of the present embodiment, the controller 1*p* selects one of two kinds of voltage sets for each pixel droplet number and performs voltage application. For each of the two kinds of voltage sets, the voltage sets have different degrees of temporal overlapping of pulse voltages included in the ejection driving voltage and the non-ejection driving voltage. Hence, by appropriately selecting the kind of voltage set, it is possible to change the amount of deformation of the actuator and thus the magnitude of energy applied to ink within the opening of the pressure chamber 16, even with the same pixel droplet number. Thus, because the size and amount of ink droplets can be changed with the same pixel droplet number, the number of tones can be increased relatively easily, thereby achieving improvement in recording quality.

Further, by stacking the piezoelectric layers 17*a* and 17*b*, high integration of parts can be achieved together with the above-described effects.

In each voltage set, each of the ejection driving voltage and the non-ejection driving voltage includes a rectangular-shaped pulse voltage. In this case, controls are easier than a case when the pulse voltage has a complicated shape (for example, a shape including a step portion where electric potential increases or decreases in a stepwise manner).

If the electric potential indicated by each of the ejection driving voltage and the non-ejection driving voltage exceeds two values (binary) in each voltage set (if high levels or low levels are different between a plurality of pulse voltages included in each voltage), there can arise structural and economical inconveniences that the number of power sources needs to be increased, and an inconvenience that the controls become more difficult. In contrast, in the present embodiment, because the electric potential indicated by each of the ejection driving voltage and the non-ejection driving voltage is two-valued, various inconveniences such as the ones described above can be avoided. Specifically, in all the voltage sets corresponding to seven tones, the electric potential indicated by the ejection driving voltage is two values of 0V and 15V, and the electric potential indicated by the non-ejection driving voltage is two values of 0V and 5V.

Each voltage set includes the non-ejection driving voltage P1. Accordingly, by applying the non-ejection driving voltage P1, it is possible to vibrate menisci (that is, by performing non-ejection flushing) and to well maintain recording quality. In addition, because the number of tones can be increased by using the piezoelectric layer 17*b* which is provided for vibrating menisci (for non-ejection flushing) for example, it is very beneficial.

The non-ejection driving voltage P1 is applied to all the actuators of the actuator unit 17 regardless of whether or not an ejection driving voltage is applied (that is, also to actuators of the pixel droplet number=0). Hence, in the ejection ports 14*a* where ink droplets are not ejected, menisci can be vibrated (that is, non-ejection flushing can be performed) by applying the non-ejection driving voltage P1. Thus, an increase in viscosity of ink in the ejection ports 14*a* can be suppressed.

In the present embodiment, vibration of menisci is generated (that is, non-ejection flushing is performed) by three pulse voltages included in the non-ejection driving voltage P1 in the case of the pixel droplet number=0, and by two or one pulse voltage included in the later part of the non-ejection driving voltage P1 in the case of the pixel droplet number=1 or 2 (small S and small L, or middle S and middle L). In the case of the pixel droplet number=1 or 2, within one recording cycle, vibration of menisci (non-ejection flushing) is performed subsequently after application of the ejection driving voltage is finished, that is, ejection of ink droplets is completed. In this way, menisci can be vibrated (that is, non-ejection flushing can be performed) by applying the non-ejection driving voltage P1 also in the ejection ports 14*a* where ink droplets are ejected.

In accordance with the above-mentioned time difference $\delta a$ or $\delta a'$ (see FIG. 8A), there arises a difference in a time period during which an actuator deforms, which changes a negative pressure value of a pressure wave that is generated in the pressure chamber 16. Thus, at the time when an ink droplet is ejected (a time point at which the volume of the pressure chamber 16 decreases by application of the ejection driving voltage), a relatively large change is generated in a positive pressure value of the pressure wave whose polarity is reversed near the outlet of the subsidiary manifold channel 13*a* and which returns to the pressure chamber 16, which changes the size and amount of an ink droplet to be ejected. Hence, by appropriately selecting a kind of voltage sets classified by the time differences $\delta a$ and $\delta a'$ for each pixel droplet number, controls of tones can be performed more easily.

In accordance with the above-mentioned time difference $\delta b$ or $\delta b'$ (see FIG. 8A), there arises a difference in a time period during which an actuator deforms, which changes a positive pressure value of a pressure wave that is generated in the pressure chamber 16. Thus, at the time when an ink droplet is ejected (a time point at which the volume of the pressure chamber 16 decreases by application of the ejection driving voltage), ejection velocity of an ink droplet changes and the size and amount of an ink droplet to be ejected also changes. Hence, by appropriately selecting a kind of voltage sets classified by the time differences $\delta b$ and $\delta b'$ for each pixel droplet number, controls of tones can be performed more easily.

The piezoelectric layer 17*b* is formed with the plurality of individual electrodes 19*a* and the connection electrodes 19*b* connecting the individual electrodes 19*a* with one another. With this arrangement, wiring configuration and signal supply configuration for the individual electrodes 19*a* can be simplified.

The connection electrodes 19*b* connect the plurality of individual electrodes 19*a* corresponding to four pressure-chamber rows sharing one subsidiary manifold channel 13*a* with one another. With this configuration, tone controls can be performed based on time-division driving for each row. Further, by performing tone controls incorporating delay time and the like for each row of the pressure chambers 16 sharing one subsidiary manifold channel 13*a*, structural crosstalk (a phenomenon that mutual propagation of residual pressure waves is generated via the subsidiary manifold channel 13*a*) can be suppressed.

Figure 8D:
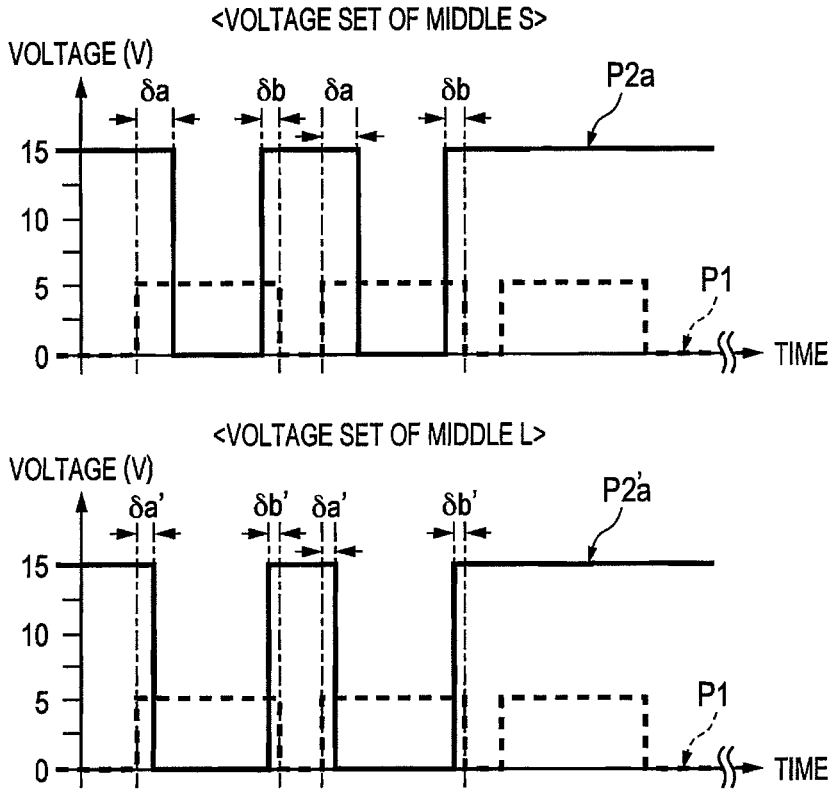
FIG. 8D includes graphs showing an example that a non-ejection driving voltage is common in two kinds of voltage sets provided for each pixel droplet number.

In two kinds of voltage sets (voltage sets of small S and small L, middle S and middle L, and large S and large L) provided for each pixel droplet number, the waveform pattern of the non-ejection driving voltage P1 is common. Thus, controls become easier. As an example, FIG. 8D illustrates two kinds of voltage sets (middle S and middle L) in the case of the pixel droplet number=2. The upper graph is a voltage set for middle S which consists of the non-ejection driving voltage P1 and ejection driving voltage P2*a*. The lower graph is a voltage set for middle L which consists of the non-ejection driving voltage P1 and ejection driving voltage P2'*a*. The waveform pattern of the non-ejection driving voltage P1 is common in the both voltage sets.

Figure 8E:
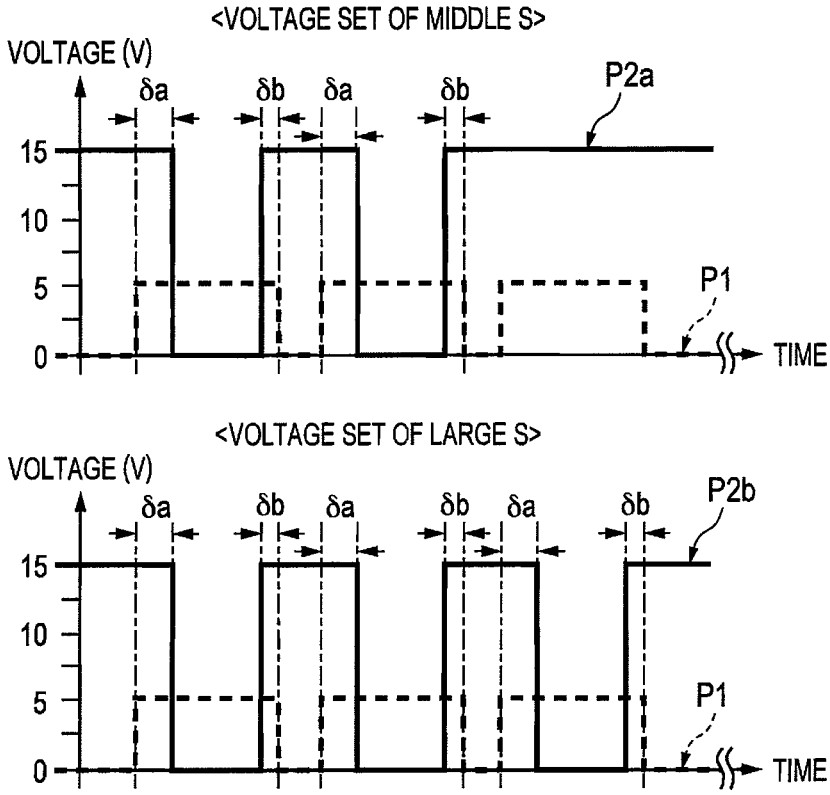
FIG. 8E includes graphs showing an example that the non-ejection driving voltage is common in voltage sets provided for different pixel droplet numbers.

The non-ejection driving voltage P1 is common in all of the seven voltage sets (voltage sets of zero, small S, small L, middle S, middle L, large S, and large L). That is, in voltage sets provided for different pixel droplet numbers, the waveform pattern of the non-ejection driving voltage P1 is common. Thus, controls become further easier. As an example, FIG. 8E illustrates a voltage set (middle S) in the case of the pixel droplet number=2 and a voltage set (large S) in the case of the pixel droplet number=3. The upper graph is a voltage set for middle S which consists of the non-ejection driving voltage P1 and the ejection driving voltage P2*a* (two pulses). The lower graph is a voltage set for large S which consists of the non-ejection driving voltage P1 and ejection driving voltage P2*b* (three pulses). The waveform pattern of the non-ejection driving voltage P1 is common in the both voltage sets.

Among the ejection driving voltage and the non-ejection driving voltage constituting each voltage set, the relatively large ejection driving voltage is applied to the piezoelectric layer 17*a* which is the outermost layer and is efficient in deformation. Hence, ejection for recording can be performed efficiently, and improvement in recording quality can be achieved.

The actuator unit 17 includes the vibration plate 17*c* arranged between the piezoelectric layers 17*a*, 17*b* and the channel unit 12 so as to close the openings of the pressure chambers 16. With this arrangement, in the actuator unit 17, it is possible to implement deformation of unimorph type, bimorph type, multimorph type, and the like, using the vibration plate 17*c*. Further, by interposing the vibration plate 17*c* between the piezoelectric layers 17*a*, 17*b* and the channel unit 12, it is possible to prevent electrical defect such as short circuit that may occur due to migration of ink ingredient within the pressure chamber 16 when voltage is applied to each of the piezoelectric layers 17*a* and 17*b*.

In the actuator unit 17, the common electrode 20 closest to the upper surface 12*x* of the channel unit 12 is a ground electrode. If the common electrode 20 is not electrically connected to ground, potential difference is created between ink within the pressure chamber 16 and the common electrode 20, and electroendosmosis of ink ingredient within the pressure chamber 16 can generate short circuit. In the present embodiment, however, this problem can be avoided.

The common electrode 20 extends over the entirety of the surface of the piezoelectric layer 17*b* and the vibration plate 17*c*. With this arrangement, electrical defect caused by leakage electric field (for example, electrical short circuit due to electroendosmosis of ink ingredient in the opening of the pressure chamber 16) can be prevented.

The piezoelectric layers 17*a* and 17*b* are polarized in the same direction along the thickness direction. If the polarizing directions in the stacking direction of the piezoelectric layers 17*a* and 17*b* are opposite from each other, in addition to the common electrode 20, a cutoff electrode needs to be newly added in order to displace the piezoelectric layers 17*a* and 17*b* in the same direction. The cutoff electrode is an electrode connected to ground like the common electrode 20. The cutoff electrode cuts off, against ink, an electric field generated by the surface electrode 18 and the internal electrode 19 sandwiching the piezoelectric layers 17*a* and 17*b* with the common electrode 20. In this case, the added cutoff electrode function as a rigid body, and becomes a factor that hinders deformation of the actuator. In contrast, in the present embodiment, there is only one ground electrode, which is the common electrode 20, thereby suppressing worsening of efficiency in deformation of the actuator.

Next, an inkjet-type printer embodying a droplet ejecting device according to a second embodiment of the invention will be described while referring to FIGS. 9A through 9C. The printer of the second embodiment differs from the first embodiment only in the configuration of the ejection driving voltage, and the other configuration is the same as in the first embodiment.

In the second embodiment, the number of tones is seven, like the first embodiment. Further, it is the same as the first embodiment in that the voltage set corresponding to each tone consists of a combination of the ejection driving voltage and the non-ejection driving voltage, that the non-ejection driving voltage is common for all the voltage sets, that two kinds (S and L) of voltage sets are provided for each pixel droplet number, that the two kinds of voltage sets are classified by a degree of temporal overlapping of pulse voltages included in each voltage constituting the sets, and the like. However, the second embodiment is different from the first embodiment in that the low level of each pulse voltage in the ejection driving voltage constituting each voltage set is not 0V (ground potential) but 5V which is the same as the high level of the non-ejection driving voltage P1. The non-ejection driving voltage P1 constituting each voltage set is the same as that of the first embodiment.

Figure 9A:
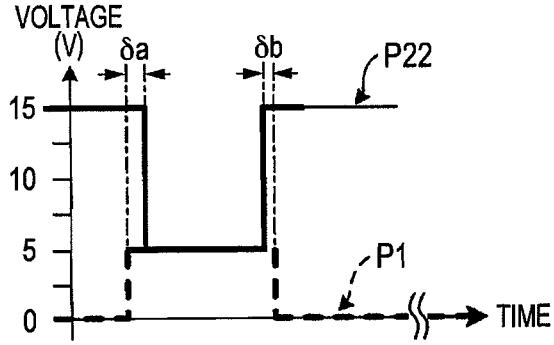
Figure 9B:
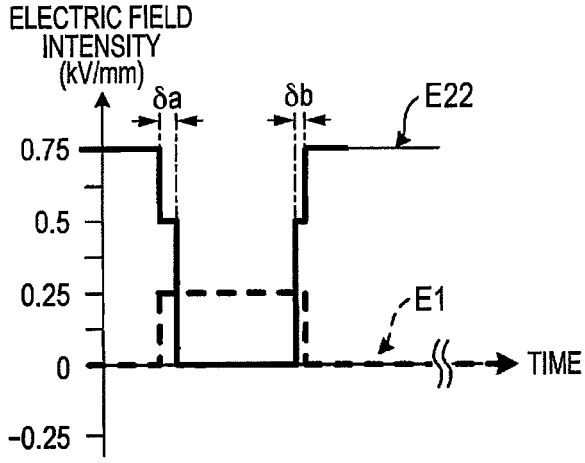
Figure 9C:
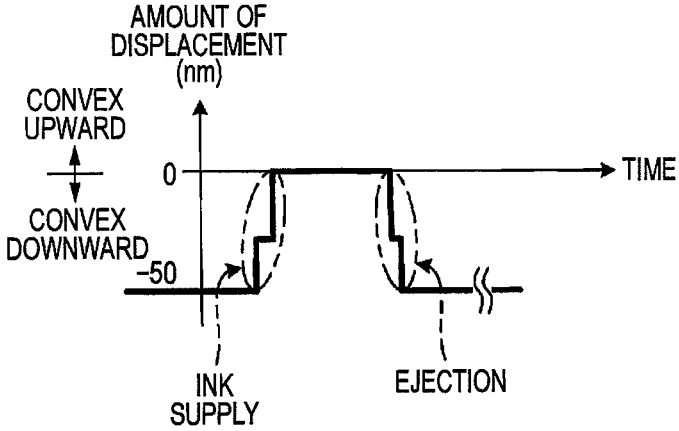

FIG. 9A illustrates one of two kinds of voltage sets provided for the case of the pixel droplet number=1. Ejection driving voltage P22 constituting the voltage set includes one pulse voltage that changes between a high level (for example, 15V) and a low level (5V) with a predetermined pulse width. The electric potential value of this low level is the same as the electric potential value of the high level of the non-ejection driving voltage P1. Hence, during application of voltage based on image data, electric field intensity E22 generated in the active portion of the piezoelectric layer 17*a* does not become a negative value (see the solid lines of FIG. 9B), and thus no electric field in the opposite direction from the polarizing direction is generated in the active portion of the piezoelectric layer 17*a*.

Although FIG. 9A illustrates one voltage set, for voltage sets other than this set as well, each pulse voltage included in the ejection driving voltage has a low level of 5V, like the ejection driving voltage P22.

As described above, according to the printer of the second embodiment, the following effects can be obtained, in addition to the effects similar to those in the first embodiment. That is, because the direction of electric field generated in the active portion of the piezoelectric layer 17*a* does not reverse during a period in which voltages are applied based on image data, reliability in driving of the actuator can be improved.

Next, an inkjet-type printer embodying a droplet ejecting device according to a third embodiment of the invention will be described while referring to FIGS. 10A through 10C. The printer of the third embodiment differs from the first embodiment only in the configuration of the ejection driving voltage, and the other configuration is the same as in the first embodiment.

In the third embodiment, the number of tones is seven, like the first embodiment. Further, it is the same as the first embodiment in that the voltage set corresponding to each tone consists of a combination of the ejection driving voltage and the non-ejection driving voltage, that two kinds (S and L) of voltage sets are provided for each pixel droplet number, that the two kinds of voltage sets are classified by a degree of temporal overlapping of pulse voltages included in each voltage constituting the sets, and the like. However, the third embodiment is different from the first embodiment in that electric potential values indicated by the ejection driving voltage are three values in each voltage set for the cases of the pixel droplet number=2 and 3. That is, in the case when the ejection driving voltage includes a plurality of pulse voltages, low level values are different from one another among the plurality of pulse voltages.

Figure 10A:
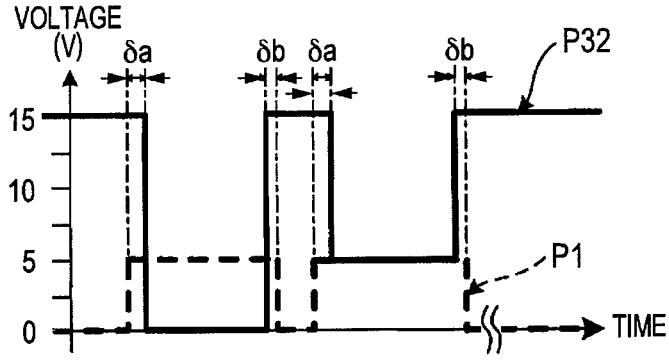
Figure 10B:
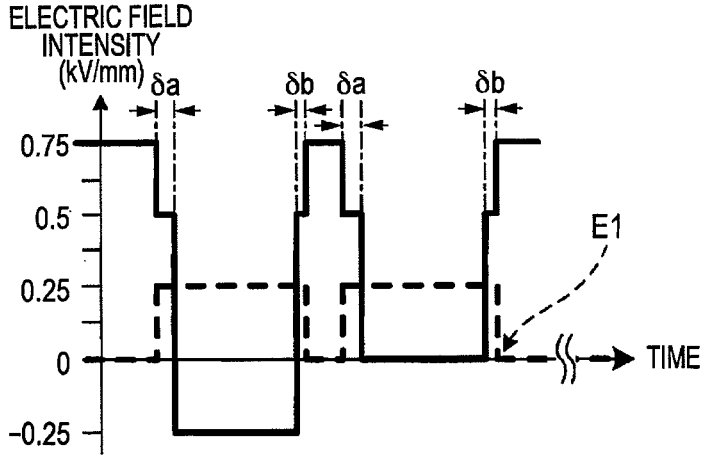
Figure 10C:
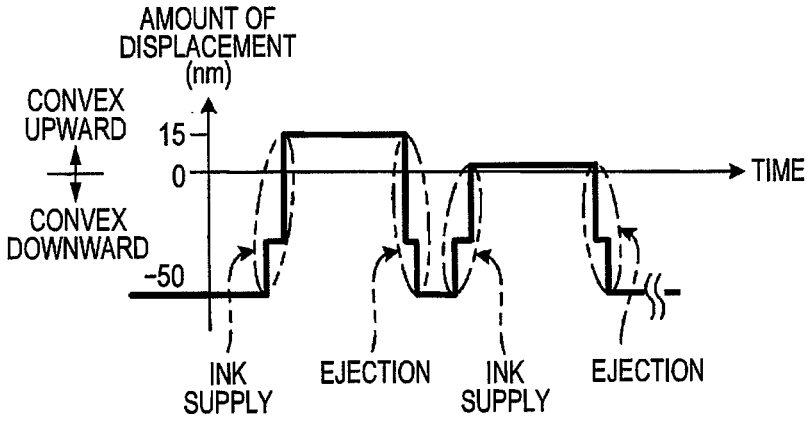

FIG. 10A illustrates one of two kinds of voltage sets provided for the case of the pixel droplet number=2. Ejection driving voltage P32 constituting the voltage set includes one pulse voltage that changes between a high level (for example, 15V) and a low level (0V) with a predetermined pulse width and one pulse voltage that changes between a high level (for example, 15V) and a low level (5V) with a predetermined pulse width. In this way, in two pulse voltages, the electric potential values of the low level are different from each other. Thus, temporal change patterns of the amount of displacement (see FIG. 10C) of the actuator are different between the first pulse voltage and the second pulse voltage. Further, because displacement velocities of the actuator during ink supply and during ejection are different between the first and second pulse voltages, the sizes of ink droplets to be ejected are also different.

The ejection driving voltage constituting each voltage set of the pixel droplet number=3 includes, subsequent to the second pulse voltage of the ejection driving voltage P32 in FIG. 10A, a pulse voltage that is the same as the second pulse voltage.

As described above, according to the printer of the third embodiment, the effects similar to those in the first embodiment can be obtained, except the effect obtained by that the electric potential values indicated by each of the ejection driving voltage and the non-ejection driving voltage are two values. Further, in the third embodiment, because the amount of displacement of the actuator is adjustable in addition to displacement velocity of the actuator, finer tone controls can be performed.

Figure 11A:
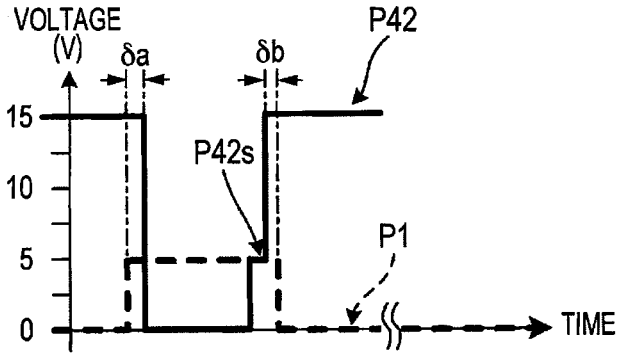
Figure 11B:
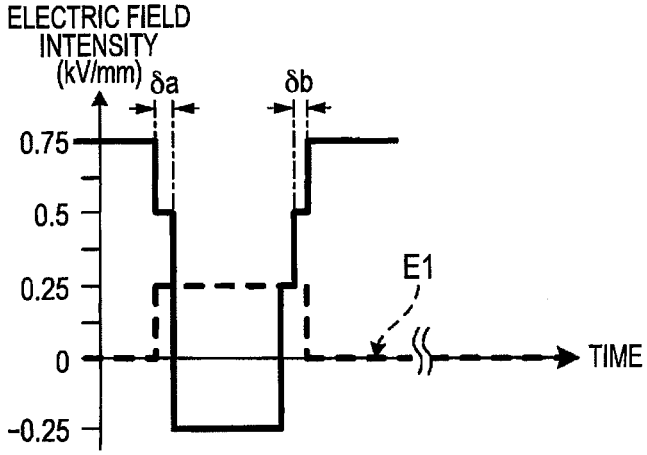
Figure 11C:
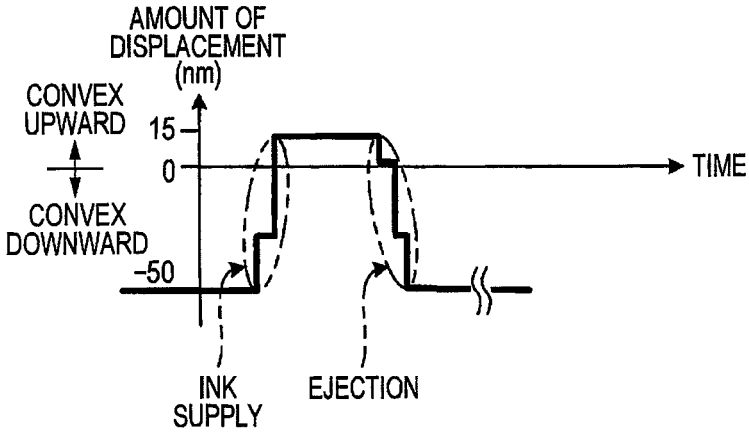

Next, an inkjet-type printer embodying a droplet ejecting device according to a fourth embodiment of the invention will be described while referring to FIGS. 11A through 11C. The printer of the fourth embodiment differs from the first embodiment only in the configuration of the ejection driving voltage, and the other configuration is the same as in the first embodiment.

In the fourth embodiment, the number of tones is seven, like the first embodiment. Further, it is the same as the first embodiment in that the voltage set corresponding to each tone consists of a combination of the ejection driving voltage and the non-ejection driving voltage, that two kinds (S and L) of voltage sets are provided for each pixel droplet number, that the two kinds of voltage sets are classified by a degree of temporal overlapping of pulse voltages included in each voltage constituting the sets, and the like. However, the fourth embodiment is different from the first embodiment in that ejection driving voltage P42 constituting a certain voltage set (for example, a voltage set for the pixel droplet number=1 shown in FIG. 11A) is not a rectangular shape but includes a pulse voltage in which the electric potential rises in a stepwise manner, that is, a step portion P42*s* is formed at the rising part of the pulse voltage.

As described above, according to the printer of the fourth embodiment, the effects similar to those in the first embodiment can be obtained, except the effect obtained by that the pulse voltage has a rectangular shape and the effect obtained by that the electric potential values indicated by each of the ejection driving voltage and the non-ejection driving voltage are two values. Further, in the fourth embodiment, the step portion P42*s* is provided to the ejection driving voltage P42 so that rising of voltage is stepwise, thereby obtaining an advantage that a temporal change in the amount of displacement of the actuator during ejection of an ink droplet can be smoothened (see FIG. 11C). The smooth change suppresses occurrences of unnecessary pressure wave within the pressure chamber 16, and highly-efficient ejection can be achieved.

While the invention has been described in detail with reference to the above embodiments thereof, it would be apparent to those skilled in the art that various changes and modifications may be made therein without departing from the scope of the claims.

In each of the above-described embodiments, the two kinds of voltage sets (S and L) are provided for each pixel droplet number. However, three or more kinds of voltage sets may be provided. For example, the number of tones can be increased by appropriately adding the voltage sets shown in the second, third, fourth embodiments etc. in addition to the seven voltage sets corresponding to the respective ones of the seven tones in the first embodiment.

In the ejection driving voltage and the non-ejection driving voltage constituting voltage sets, it is not necessary that all the pulse voltages have temporal overlapping with each other, and there may be pulse voltages that do not have temporal overlapping with each other. For example, in the above-described first embodiment, there may be pulse voltages that do not have temporal overlapping with each other in the ejection driving voltage and the non-ejection driving voltage constituting each voltage set of middle L and large L.

Further, it may be so configured that there is no temporal overlapping of pulse voltages at all in the ejection driving voltage and the non-ejection driving voltage constituting a certain voltage set. For example, in the above-described first embodiment, it may be so configured that there is no temporal overlapping of pulse voltages at all in the ejection driving voltage and the non-ejection driving voltage constituting each voltage set of small L, middle L, and large L.

The starting and ending time points of the overlapping of pulse voltages, the time period of the overlapping, and the like are not limited to specific time points or time period.

In the above-described embodiments, the non-ejection driving voltage is applied to all the actuators of the actuator unit 17, regardless of whether or not the ejection driving voltage is applied. However, the operation is not limited to this. The non-ejection driving voltage may be applied only to actuators to which the ejection driving voltage is applied.

It may be so configured that no meniscus vibration (non-ejection flushing) by application of the non-ejection driving voltage is performed at the actuators to which the ejection driving voltage is applied. For example, in the above-described first embodiment, the non-ejection driving voltage included in the voltage set of the pixel droplet number=1 may include only one pulse voltage which has temporal overlapping with the ejection driving voltage.

It may be so configured that the non-ejection driving voltage is not common in two or more kinds of voltage sets provided for each pixel droplet number (In other words, the non-ejection driving voltage may be different among two or more kinds of voltage sets provided for each pixel droplet number). Further, it may be so configured that the non-ejection driving voltage is not common in voltage sets corresponding to all the tones (In other words, the non-ejection driving voltage may be different in voltage sets corresponding to at least some of all the tones).

A first voltage and a second voltage constituting a voltage set are not limited to the non-ejection and ejection driving voltages. More specifically, waveform characterizing each voltage, pulse width, timing of rising and falling, electric potential values of a low level and a high level, etc. can be changed appropriately according to various conditions of ambient temperature, ink viscosity, and the like. For example, pulse voltages included in each voltage are not limited to rectangular shapes, and may have shapes including the step portion P42*s*, like the fourth embodiment. Further, electric potential indicated by each pulse voltage may be three-valued, or four-valued or more, like the third and fourth embodiments.

In the second embodiment, the low level value of each pulse voltage included in the ejection driving voltage is the same electric potential value (5V) as the high level value of the non-ejection driving voltage P1. However, as long as it is greater than or equal to the electric potential value of the high level of the non-ejection driving voltage P1, the direction of an electric field generated in the active portion of the piezoelectric layer 17*a* does not reverse. Hence, the above-described effects of the second embodiment can be obtained.

The surface electrodes 18 and the internal electrode 19 may be kept at a float potential at normal times (at the times except when recording, non-ejection flushing, and the like are performed).

The arrangement and shape of the piezoelectric layers and electrodes included in the actuator as well as the deformation mode of the actuator are not limited to those described in the above embodiments and may be modified in various ways.

The deformation mode of the actuator is not to limited to the unimorph type, and may be other deformation modes such as a monomorph type, bimorph type, multimorph type, and a modified type of the monomorph type etc.

In the actuator unit 17, another piezoelectric layer may be stacked on the piezoelectric layer 17*a* as the upper layer, or one or a plurality of piezoelectric layers may be sandwiched between the piezoelectric layers 17*a* and 17*b*. Further, the vibration plate 17*c* may be omitted.

In the above-described embodiments, the thickness of the piezoelectric layer 17*a* is greater than the sum of the thickness of the piezoelectric layer 17*b* and the thickness of the vibration plate 17*c*. Because the thickness of the piezoelectric layer 17*a* for recording ejection operations is designed to be relatively large in this way, the deformation efficiency of the actuator unit for recording ejection operations can be improved. However, the thickness of each piezoelectric layer included in the actuator is not limited to this relationship, and may be modified appropriately. For example, the sum of the thickness of the piezoelectric layer 17*a* and the thickness of the piezoelectric layer 17*b* may be the same as the thickness of the vibration plate 17*c*, or may be greater than the thickness of the vibration plate 17*c*.

In the above-described embodiments, the ejection driving voltage is applied to the piezoelectric layer 17*a* which is the upper piezoelectric layer, whereas the non-ejection driving voltage is applied to the piezoelectric layer 17*b* which is the lower piezoelectric layer. However, application of the voltages is not limited to this. For example, the non-ejection driving voltage may be applied to the piezoelectric layer 17*a* which is the upper piezoelectric layer, whereas the ejection driving voltage may be applied to the piezoelectric layer 17*b* which is the lower piezoelectric layer.

The piezoelectric layers 17*a* and 17*b* may be polarized in the opposite direction from each other along the stacking direction.

It is not necessary that each surface electrode 18 has a similarity shape to the shape of the opening of the pressure chamber 16 and has a size smaller than the opening as viewed in the stacking direction of the piezoelectric layers 17*a* and 17*b*. As long as the surface electrodes 18 are arranged to confront the pressure chambers 16, the surface electrodes 18 may have various shapes and sizes.

Figure 6C:
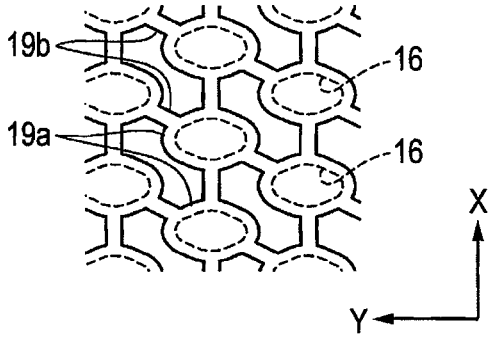
FIG. 6C is a plan view showing an internal electrode included in the actuator unit.

As shown in FIG. 6C, each individual electrode 19*a* of the internal electrode 19 has a similarity shape to the opening of the pressure chamber 16 as viewed in the stacking direction of the piezoelectric layers 17*a* and 17*b*. However, the shape is not limited to this design. For example, it may be so configured that the individual electrode 19*a* is not a similarity shape to the opening of the pressure chamber 16. As long as the individual electrode 19*a* has a size larger than the opening, alignment of the individual electrode 19*a* relative to the opening can be performed with a high precision and with ease, when the piezoelectric layers 17*a* and 17*b* on which the internal electrode 19 is formed are contracted due to burning. Further, it may be so configured that each individual electrode 19*a* of the internal electrode 19 does not have a size larger than the opening of the pressure chamber 16. Further, it is not necessary that the internal electrode 19 includes the individual electrodes 19*a* confronting the respective ones of the openings of the pressure chambers 16 and the connection electrodes 19*b* connecting the individual electrodes 19*a* with one another. For example, like the surface electrodes 18, it may be so configured that individual electrodes confronting the respective ones of the openings of the pressure chambers 16 are separated from one another, without being connected by connection electrodes.

In the above-described embodiments, the connection electrodes 19*b* connect the individual electrodes 19*a* corresponding to the pressure chambers 16 sharing one subsidiary manifold channel 13*a*, taking the subsidiary manifold channel 13*a* as a unit. However, the connection pattern is not limited to this. For example, the connection electrodes 19*b* may connect the individual electrodes 19*a* corresponding to each pressure-chamber row, without taking the subsidiary manifold channel 13*a* as a unit. Alternatively, the connection electrodes 19*b* may connect all the individual electrodes 19*a* included in one actuator unit 17. In the case where the connection electrodes 19*b* connect all the individual electrodes 19*a* included in one actuator unit 17, it is sufficient that wiring is provided to only one point of the individual electrode 19*a* or the connection electrode 19*b*, thereby simplifying the wiring configuration and also simplifying the configuration for supplying signals.

It is not necessary that the internal electrode 19 is formed in a pattern including the individual electrodes 19*a* and the connection electrodes 19*b*. The internal electrode 19 may be formed over the entire surface of the piezoelectric layer 17*b*, like the common electrode 20.

It may be so configured that the electrode located closest to the upper surface 12*x* of the channel unit 12 in the actuator unit 17 (the common electrode 20 in the above-described embodiments) is not ground electrode. Further, it is not necessary that the electrode extends over the entire surface, and the electrode may be formed, for example, in the same pattern as the internal electrode 19.

In the above-described embodiments, descriptions are provided on the actuator unit 17 including a large number of active portions corresponding to the respective ones of a large number of the pressure chambers 16. However, the actuator of the invention is not limited to this configuration. The actuator may be provided individually to each pressure chamber 16 of the head 10, where a piezoelectric layer is arranged to confront only one pressure chamber 16 without straddling a plurality of pressure chambers 16.

The vibration mode of the piezoelectric layer 17*a*, the deformation mode of the actuator, and the like are not limited to a specific mode. For example, the above-described embodiments adopt "pull and eject method" with the vibration mode $d_{31}$ of the piezoelectric layer 17*a*. However, "push and eject method" may be adopted with the vibration mode $d_{31}$ of the piezoelectric layer 17*a*. Further, "push and eject method" or "pull and eject method" may be adopted with the vibration mode $d_{33}$ of the piezoelectric layer 17*a*. If the "push and eject method" is adopted, the ejection driving voltage includes, for example, one or more pulse voltage that changes between a low level (0V: ground potential) and a high level (15V, for example) with a predetermined pulse width therebetween. An ink droplet is ejected from the ejection port 14*a* at the timing of rising of the pulse voltage, and ink is supplied into the pressure chamber 16 at the timing of falling of the pulse voltage. In this case, the non-ejection driving voltage may include, for example, one or more pulse voltage that changes between a high level (5V, for example) and a low level (0V: ground potential) with a predetermined pulse width therebetween.

In the above-described embodiments, the form of temporal overlapping between pulse voltages has a relationship that the application period of a pulse voltage of the ejection driving voltage is included within the application period of a pulse voltage of the non-ejection driving voltage. However, it may have the opposite relationship. Alternatively, it may have a relationship that one pulse voltage partly overlaps the other pulse voltage. For example, the time points may appear in the temporal sequence of time point t1, time point T1 (time point T1'), time point t2, and time point T2 (time point T2'). Further, the time points may be in the temporal sequence of time point T1 (time point T1'), time point t1, time point T2 (time point T2'), and time point t2. Further, the timing of falling of one pulse voltage may coincide with the timing of rising of the other pulse voltage.

The definition of relative movement in a recording cycle includes not only the case in which paper P moves relative to the head 10 located at a fixed position, but also the case in which the head 10 moves relative to paper P located at a fixed position.

The invention can be applied to both of the line type and the serial type. Further, it is not limited to a printer, but can be applied to a facsimile apparatus, a copier, and the like. Further, it can also be applied to an apparatus that ejects droplets other than ink droplets.

What is claimed is:

1. A liquid ejecting device comprising:

a channel member formed with a liquid channel having an ejection port for ejecting droplets, the channel member having a surface formed with an opening through which a part of the liquid channel is exposed;

an actuator including a layered body disposed on the surface of the channel member so as to confront the opening for applying energy to liquid in the opening, the layered body including a first piezoelectric layer and a second piezoelectric layer arranged from a side closer to the surface of the channel member in this order, each of the first and second piezoelectric layers including an active portion in a part in confrontation with the opening, the active portion being interposed between electrodes with respect to a thickness direction;

a driving-signal generating section configured to generate driving signals for driving the actuator, the driving-signal generating section being configured to generate a first driving signal corresponding to a first voltage applied to the active portion of the first piezoelectric layer and a second driving signal corresponding to a second voltage applied to the active portion of the second piezoelectric layer;

a voltage-set-information storing section that stores two or more kinds of voltage sets each including a combination of the first and second voltages for each number of droplets ejected from the ejection port within a single recording cycle, where the single recording cycle is a time period required for a recording medium to move relative to the channel member by a unit distance corresponding to a resolution of an image to be recorded on the recording medium; and a voltage applying section configured to apply the first voltage to the active portion of the first piezoelectric layer and to apply the second voltage to the active portion of the second piezoelectric layer based on image data of the image, the voltage applying section being configured to select one of the two or more kinds of voltage sets stored in the voltage-set-information storing section and to apply each voltage constituting the selected voltage set to the active portions of the first and second piezoelectric layers, wherein the voltage sets are classified by a degree of temporal overlapping of pulse-shaped voltages included in the first and second voltages.

2. The liquid ejecting device according to claim 1, wherein each of the first and second voltages includes a rectangular-shaped pulse voltage.

3. The liquid ejecting device according to claim 2, wherein each of the first and second voltages indicates two-valued electric potential.

4. The liquid ejecting device according to claim 1, wherein one of the first and second driving signals is an ejection driving signal that, with only said ejection driving signal, can cause a droplet to be ejected from the ejection port; and wherein another one of the first and second driving signals is a non-ejection driving signal that, with only said non-ejection driving signal, cannot cause a droplet to be ejected from the ejection port and that causes a meniscus formed in the ejection port to be vibrated without causing a droplet to be ejected from the ejection port.

5. The liquid ejecting device according to claim 4, wherein the voltage applying section is configured to selectively apply an ejection pulse voltage corresponding to the ejection driving signal to a plurality of active portions in one of the first and second piezoelectric layers, and to apply a non-ejection pulse voltage corresponding to the non-ejection driving signal to a plurality of active portions in another one of the first and second piezoelectric layers regardless of application of the ejection pulse voltage to the active portions in the one of the first and second piezoelectric layers in confrontation with the active portions in the another one of the first and second piezoelectric layers.

6. The liquid ejecting device according to claim 4, wherein the voltage applying section is configured to apply a non-ejection pulse voltage corresponding to the non-ejection driving signal during one of time periods in which an ejection pulse voltage corresponding to the ejection driving signal is not applied.

7. The liquid ejecting device according to claim 4, wherein the voltage sets are classified by a time difference between: a time point T1 at which the second piezoelectric layer starts deforming based on the ejection driving signal so that volume of a part of the liquid channel increases; and a time point t1 at which the first piezoelectric layer starts deforming based on the non-ejection driving signal that is temporally closest to the time point T1 so that the volume of the part of the liquid channel decreases.

8. The liquid ejecting device according to claim 4, wherein the voltage sets are classified by a time difference between: a time point T2 at which the second piezoelectric layer starts deforming based on the ejection driving signal so that volume of a part of the liquid channel decreases; and a time point t2 at which the first piezoelectric layer starts deforming based on the non-ejection driving signal that is temporally closest to the time point T2 so that the volume of the part of the liquid channel increases.

9. The liquid ejecting device according to claim 4, wherein one of the first and second piezoelectric layers to which the non-ejection driving signal is applied is formed with a plurality of individual electrodes separated from one another and each forming a plurality of active portions and connection electrodes that connect the plurality of individual electrodes with one another.

10. The liquid ejecting device according to claim 9, wherein the liquid channel includes a plurality of pressure chambers each being the part including the opening, the plurality of pressure chambers being arranged in a direction along the surface and constituting a plurality of rows; and wherein the connection electrodes connect the plurality of individual electrodes corresponding to one or a plurality of the rows with one another.

11. The liquid ejecting device according to claim 1, wherein a waveform pattern of one of the first and second voltages is common in the two or more kinds of voltage sets provided for each number of droplets ejected from the ejection port within the single recording cycle.

12. The liquid ejecting device according to claim 11, wherein the waveform pattern of the one of the first and second voltages is common in the voltage sets provided for different numbers of droplets ejected from the ejection port within the single recording cycle.

13. The liquid ejecting device according to claim 1, wherein the second piezoelectric layer is an outermost layer which is the farthest away from the surface of the channel member among piezoelectric layers included in the layered body; and wherein the second driving signal is an ejection driving signal that, with only said ejection driving signal, can cause a droplet to be ejected from the ejection port.

14. The liquid ejecting device according to claim 1, wherein the actuator further comprises a vibration plate disposed between the layered body and the channel member to seal the opening.

15. The liquid ejecting device according to claim 1, wherein an electrode in the actuator that is closest to the surface of the channel member is a ground electrode.

16. The liquid ejecting device according to claim 15, wherein the ground electrode extends over an entirety of a surface on which the ground electrode is formed.

17. The liquid ejecting device according to claim 15, wherein the first and second piezoelectric layers are polarized in the same direction along a thickness direction.

18. The liquid ejecting device according to claim 1, wherein the voltage applying section is configured to perform voltage application so as not to reverse a direction of an electric field generated in the active portion, during a period in which each voltage is applied to the active portions of the first and second piezoelectric layers based on the image data.

* * * * *